United States Patent [19]

Mouri

[11] Patent Number: 4,999,676

[45] Date of Patent: Mar. 12, 1991

[54] IMAGE FORMING APPARATUS HAVING COMMON SIGNAL LINES

[75] Inventor: Takashi Mouri, Iruma, Japan

[73] Assignees: Casio Computer Co., Ltd.; Casio Electronics Manufacturing Co., Ltd., Tokyo, Japan

[21] Appl. No.: 497,540

[22] Filed: Mar. 22, 1990

[30] Foreign Application Priority Data

| | | | |
|---|---|---|---|
| Mar. 27, 1989 | [JP] | Japan | 1-74238 |
| Oct. 25, 1989 | [JP] | Japan | 1-278042 |
| Nov. 29, 1989 | [JP] | Japan | 1-138201[U] |

[51] Int. Cl.[5] ..... G03G 15/08

[52] U.S. Cl. ..... 355/246; 355/251; 355/326; 118/689; 118/656

[58] Field of Search ..... 118/688, 689, 690, 691, 118/645, 656–658; 355/245, 246, 251, 328, 326

[56] References Cited

U.S. PATENT DOCUMENTS

| | | | |
|---|---|---|---|
| 4,210,864 | 7/1980 | Miyakawa et al. | 118/689 X |
| 4,240,375 | 12/1980 | Terashima | 118/689 |
| 4,397,265 | 8/1983 | Terashima | 118/694 |
| 4,468,112 | 8/1984 | Suzuki et al. | 118/689 X |
| 4,583,491 | 4/1986 | Suzuki | 118/689 |
| 4,632,534 | 12/1986 | Shimono | 118/656 X |
| 4,646,679 | 3/1987 | Ohno et al. | 118/691 |
| 4,647,185 | 3/1987 | Takeda et al. | 118/689 X |
| 4,668,074 | 5/1987 | Hirozane | 118/689 X |
| 4,841,329 | 6/1989 | Kasamura et al. | 355/245 |
| 4,885,611 | 12/1989 | Kimihiko et al. | 355/245 |
| 4,932,356 | 6/1990 | Watanabe et al. | 355/246 X |
| 4,956,668 | 9/1990 | Aronold et al. | 355/245 X |

*Primary Examiner*—R. L. Moses

*Attorney, Agent, or Firm*—Nixon & Vanderhye

[57] ABSTRACT

An image forming apparatus includes an image forming unit and a main body. The image forming unit is detachably mounted in a main body of the image forming apparatus and has at least a developing device for storing a predetermined developer for forming a desired image. A sensor circuit generates a detection signal upon detection of the state of the developer in the developing device. A connecting section outputs the detection signal to the main body. A transmitting section has a single portion to be connected and transmits, to the main body side, the detection signal and a signal representing a mounting state of the image forming unit, which is generated in accordance with a coupling state of the connecting section with respect to the single portion. A discriminating circuit has a single input terminal for receiving a signal from the single portion of the transmitting section, and discriminates the state of the developer in the developing device and a mounting state of the image forming unit with respect to the main body on the basis of the state of the signal input to the input terminal.

20 Claims, 19 Drawing Sheets

| | INPUT CONDITIONS | | | OUTPUT | |
|---|---|---|---|---|---|
| | CONNECTION OF UNIT | DEVELOPER | DENSITY OF DEVELOPER | A/D-CONVERTED DATA | |
| | | | | S : ON | S : OFF |
| A | ABSENT | — | — | VCC | / |
| B | PRESENT | ABSENT | — | ≠ VCC | ≈ 0 V |
| C | PRESENT | PRESENT | NORMAL | ≠ VCC | 2.5 V |
| D | PRESENT | PRESENT | LOW | ≠ VCC | 4 V |
| E | PRESENT | PRESENT | HIGH | ≠ VCC | 1 V |

IMAGE FORMING APPARATUS HAVING COMMON SIGNAL LINES

BACKGROUND OF THE INVENTION

1. Field of the Invention

The present invention relates to an image forming apparatus using an electrophotographic system and, more particularly, to an image forming apparatus having a discriminating unit for discriminating the mounting/ dismounting of a developing unit used in the apparatus, the presence/absence of a developer in the developing unit, and the toner density of the developer. 2. Description of the Related Art A development system used in an image forming apparatus such as a copying machine or various types of printers includes a developing unit arranged near the outer surface of a photosensitive drum. A developing roll is arranged in the developing unit and a developer attached to the developing roll is positioned to be brought into slidable contact with the photosensitive drum. A toner which is sufficiently agitated by an agitating rod is attracted to a peripheral portion of the developing roll. A toner sensor for detecting a toner residual amount is mounted in the lower portion of the developing unit. A piezoelectric type sensor and a reactance detection type sensor are known as toner sensors. When the lack of the developer is detected by the sensor, an operator is informed of the lack, and a new developer is replenished.

FIG. 1 shows a state wherein a toner sensor 7 is electrically connected to a printer controller 8 in a printer main body through cables. Referring to FIG. 1, reference numeral 9 denotes a toner detector for supplying a signal from the toner sensor 7 to a CPU 10. The CPU 10 incorporates a ROM for storing a control program, a RAM for temporarily storing data to be processed by the CPU 10, and the like, and constitutes a central processing unit. Reference numeral 11 denotes a display section for displaying the presence/absence of a toner and error contents.

An output from the toner sensor 7 for detecting the presence/absence of a toner in the developing unit 1 is supplied to the toner detector 9. Upon detection of the lack of a toner, the toner sensor 7 outputs, e.g., a 3.5-kHz rectangular signal. This signal is smoothed by resistors R1 to R3 and capacitors C1 and C2 in the toner detector 9, and is supplied to a transistor Q1 as a high-level signal so as to turn on the transistor Q1 and a transistor Q2. As a result, a low-level signal, as a signal representing the lack of the toner, is input to a terminal IN1 of the CPU 10. If the toner sensor 7 detects the presence of a toner, the toner sensor 7 stops outputting the rectangular signal. Consequently, the transistors Q1 and Q2 are turned off, and a high-level signal is output to the terminal IN1 of the CPU 10. The CPU 10 causes the display section 11 to display the presence/absence of a toner in accordance with the low- or high-level signal input from the terminal IN1.

Since the developing unit 1 is designed to be detachably mounted, as a unit, in the printer main body, it can be exchanged with another developing unit when a developer having a different color is to be used or the service life of a developer comes to an end. However, the printer main body must detect whether a developing unit is mounted or not, and inhibit a developing (printing) operation when no developing unit is mounted. In a conventional apparatus, the mounting/dismounting of the developing unit 1 is detected in the following manner. When the developing unit 1 is not mounted in the printer main body, a high-level signal is input to an input terminal IN2 of the CPU 10 through a pull-up resistor R4. In contrast to this, when terminals 3' and 4', which are connected to each other on the developing unit 1 side, are respectively connected to input terminals 3 and 4 of the printer controller 8, i.e., the developing unit 1 is mounted in the printer main body, a low-level signal is input to the CPU 10. The mounting/dismounting of the developing unit 1 can be discriminated by using signal inputs which have different levels depending on the mounting/dismounting of the developing unit 1.

In the above-described image forming apparatus, however, extra signal lines are used only for the detection of the mounting state of a developing unit. In addition, when a toner density is to be detected, another extra signal line is required. This increases a rate of occurrence of noise. In addition, extra input ports of the CPU are required.

These problems lead to not only degradation in reliability of the apparatus but also an increase in manufacturing cost.

SUMMARY OF THE INVENTION

It is, therefore, an object of the present invention to provide an image forming apparatus which can realize an improvement in reliability and a decrease in cost.

In order to achieve the above object, according to the present invention, there is provided an image forming apparatus comprising:

an image forming unit, detachably mounted in a main body of the image forming apparatus and having at least a developing device for storing a predetermined developer for forming a desired image;

sensor means, arranged on the side of the image forming unit, for detecting a state of the developer in the developing device and generating a detection signal;

connecting means, arranged on the side of the image forming unit, for outputting the detection signal generated by the sensor means to the main body;

transmitting means, having a single portion to be connected arranged on the main body side, for transmitting, to the main body side, the detection signal generated by the sensor means and a signal representing a mounting state of the image forming unit, which is generated in accordance with a coupling state of the connecting means of the image forming unit with respect to the single portion; and discriminating means, having a single input terminal for receiving a signal from the single portion of the transmitting means, for discriminating a state of the developer in the developing device and a mounting state of the image forming unit with respect to the main body on the basis of a state of the signal input to the input terminal.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

An image forming apparatus according to the first embodiment of the present invention will be described in detail below with reference to the accompanying drawings.

Figure 3:
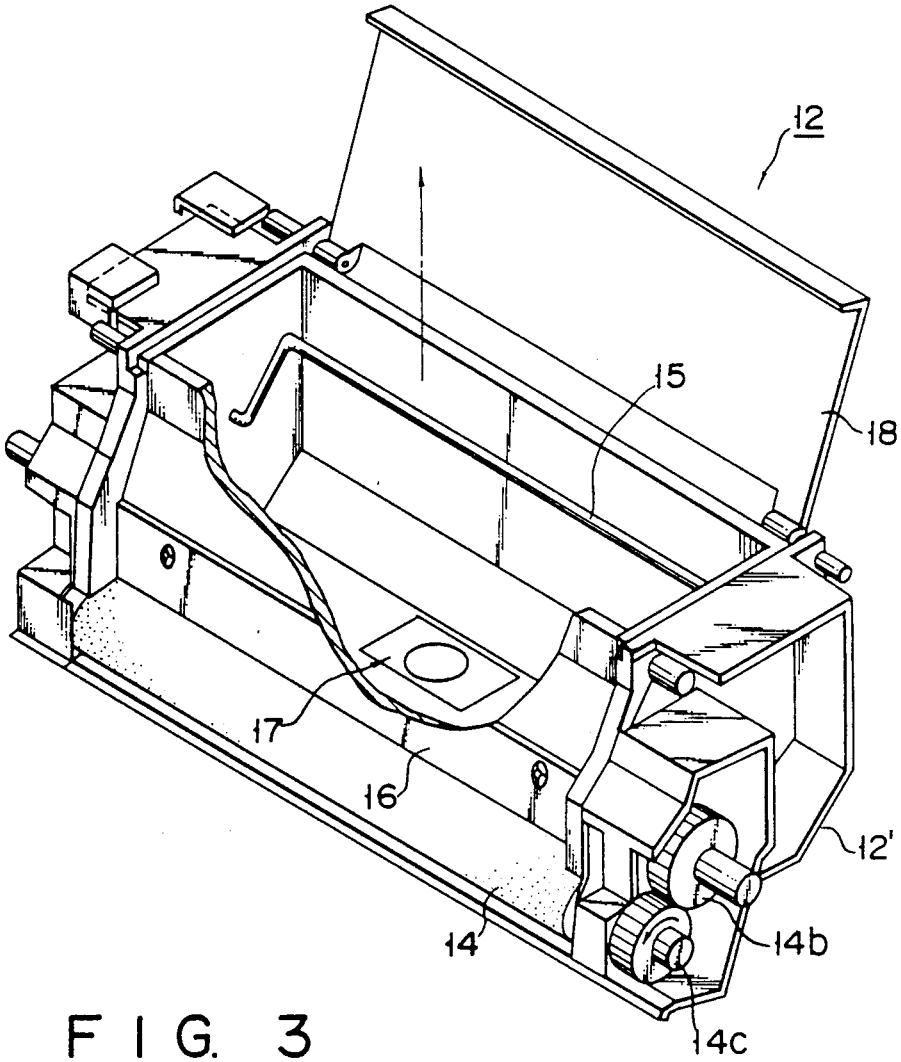
FIG. 3 is a perspective view of a developing unit to which the discriminating unit according to the first embodiment of the present invention is applied.
Figure 4:
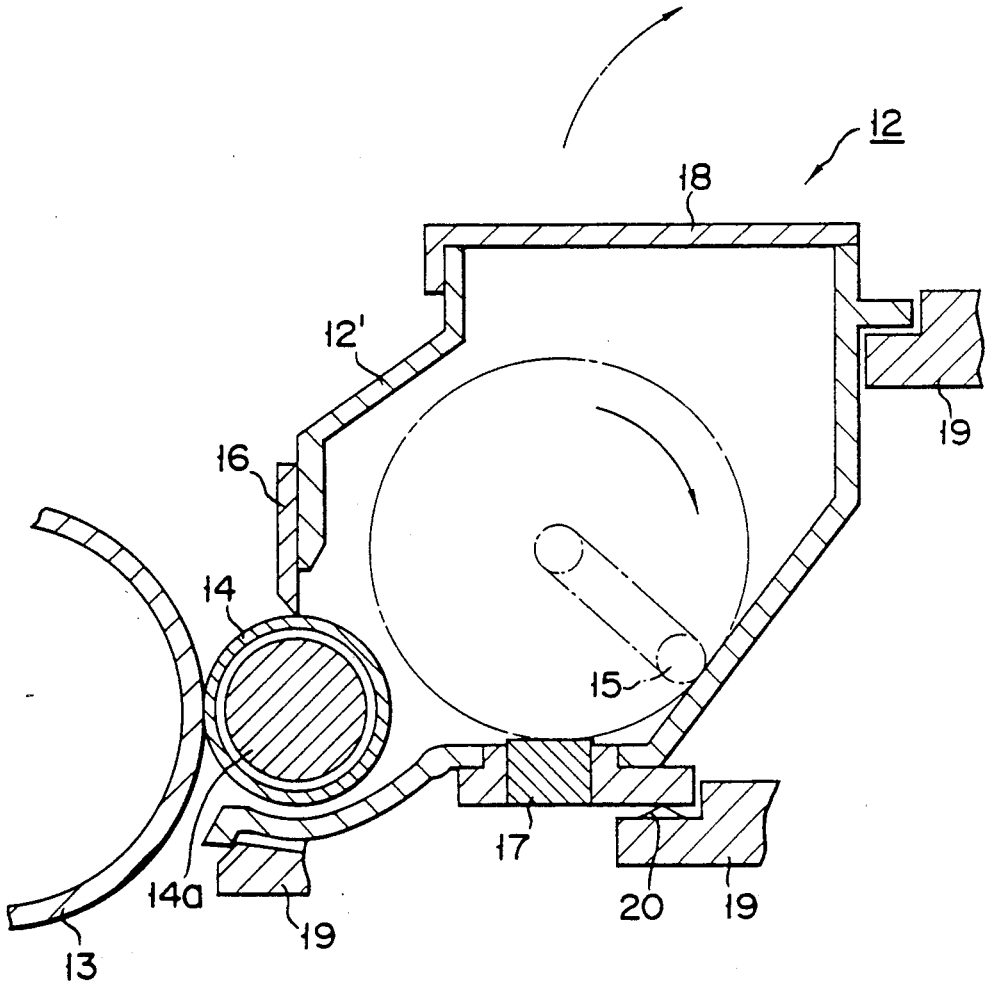
FIG. 4 is a sectional view of FIG. 3.

FIG. 3 is a partially cutaway perspective view of a developing unit in, e.g., a printer to which a discriminating unit in an image forming apparatus of the first embodiment is applied. FIG. 4 is a sectional view of the developing unit. Referring to FIGS. 3 and 4, a developing unit 12 comprises: a developing sleeve 14 which brings a developer including a one-component magnetic toner into slidable contact with a photosensitive drum 13 and incorporates a magnet roll 14*a*; an agitating rod 15 for agitating a developer stored in a developing hopper 12'; a blade 16 for restricting the thickness of the developer attracted to the outer surface of the sleeve 14; and a toner sensor 17 for detecting the residual amount of the developer (toner) in the hopper 12'. When the hopper 12' is to be replenished with a developer (toner). a lid 18 arranged on the upper portion of the hopper 12' is opened in a direction indicated by an arrow in FIG. 3. A rotating force from, e.g., a main motor of the printer is transmitted to the developing sleeve 14 through gears 14*b* and 14*c*, and to the agitating rod 15 through gears (not shown). The developing unit 12 is designed to be detachably mounted in a casing 19 of the printer. While the developing unit 12 is mounted in the casing 19, an output signal from the toner sensor 17 is output to a printer controller 21 through a plurality of contacts 20 formed in the casing 19.

Figure 1:
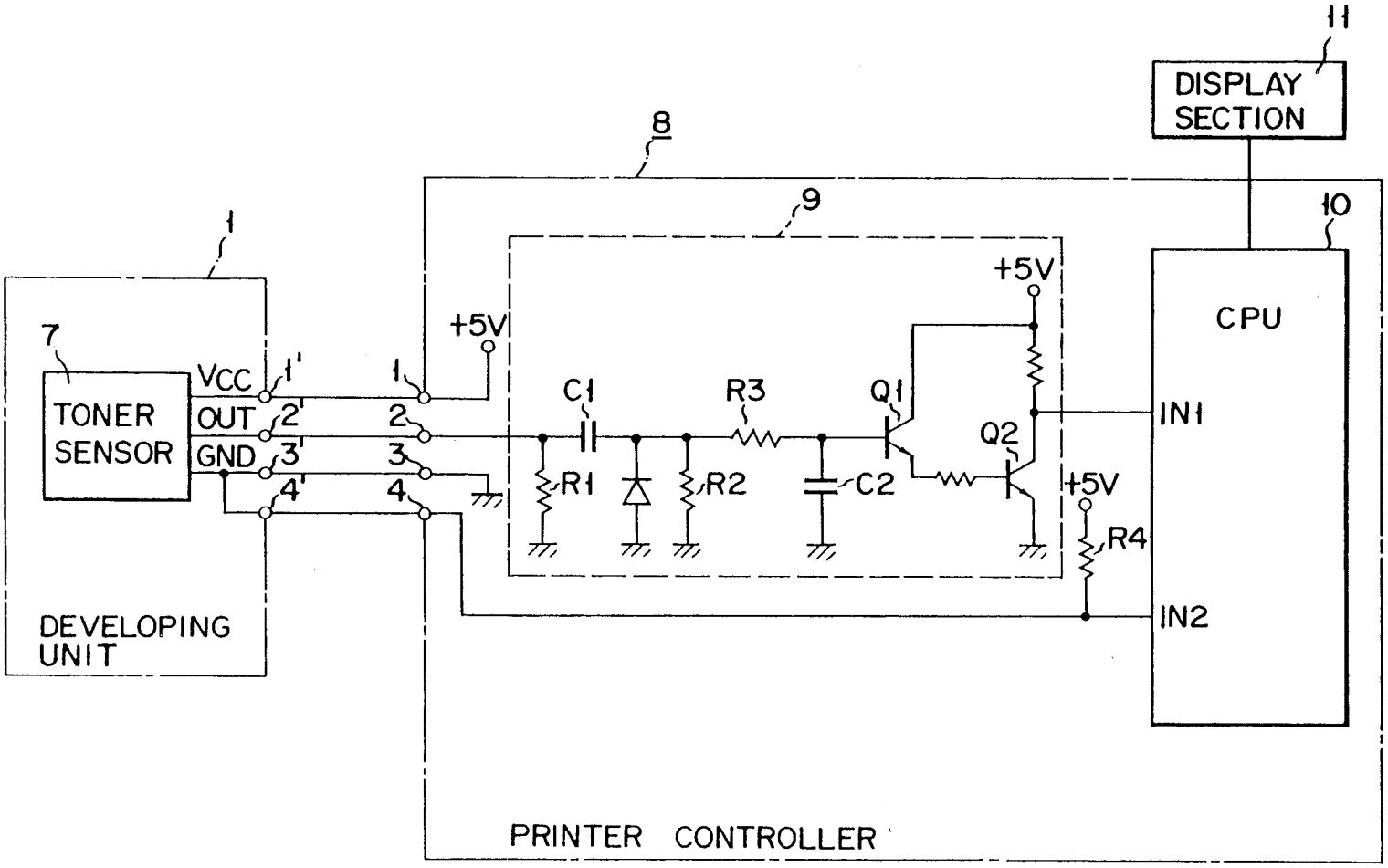
FIG. 1 (PRIOR ART)
FIG. 1 is a circuit diagram showing an arrangement of a discriminating unit of a conventional image forming apparatus.
Figure 2A:
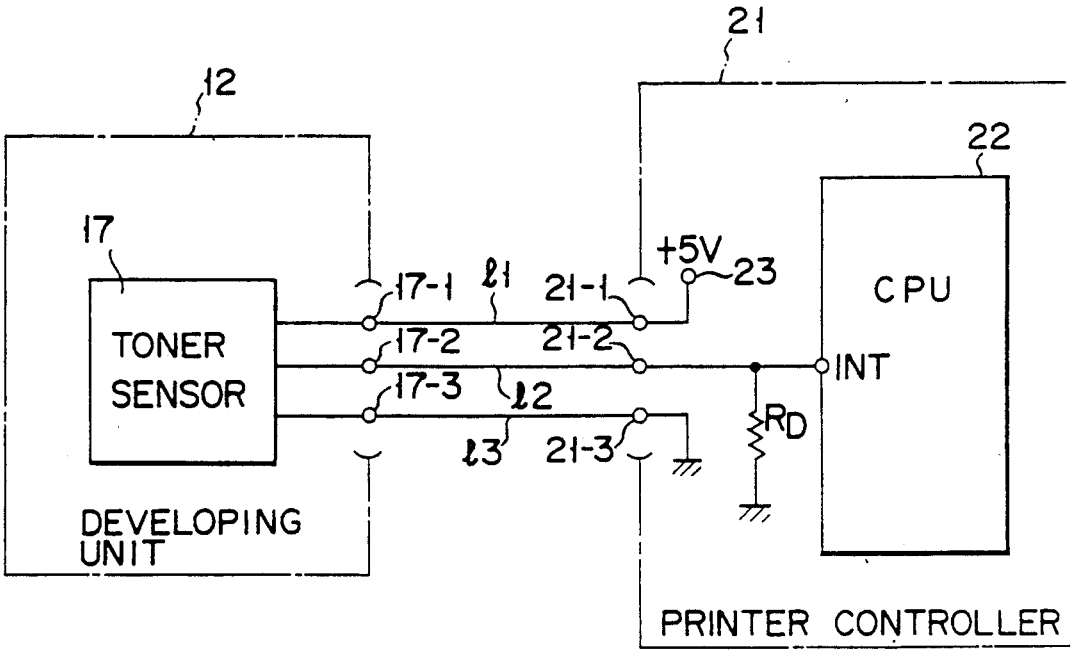
FIG. 2A is a block diagram showing a circuit arrangement of a discriminating unit in an image forming apparatus according to the first embodiment of the present invention.

FIG. 2A is a block diagram showing a connecting arrangement and a circuit arrangement of the toner sensor 17 and the printer controller 21. The toner sensor 17 and the printer controller 21 are connected to each other through three lines, namely, a power source line l1, a signal line l2, and a ground line l3. A voltage of 5 V is applied from the printer controller 21 to the toner sensor 17 through an output terminal 21-1, the power source line l1, and an input terminal 17-1. An output signal (to be described later in detail) representing the presence/absence of a toner is supplied from the toner sensor 17 to the printer controller 21 through an output terminal 17-2, the signal line l2, and an input terminal 21-2. The toner sensor 17 is connected to ground of the printer controller 21 through a ground terminal 17-3, the ground line l3, and a ground terminal 21-3.

Figure 2B:
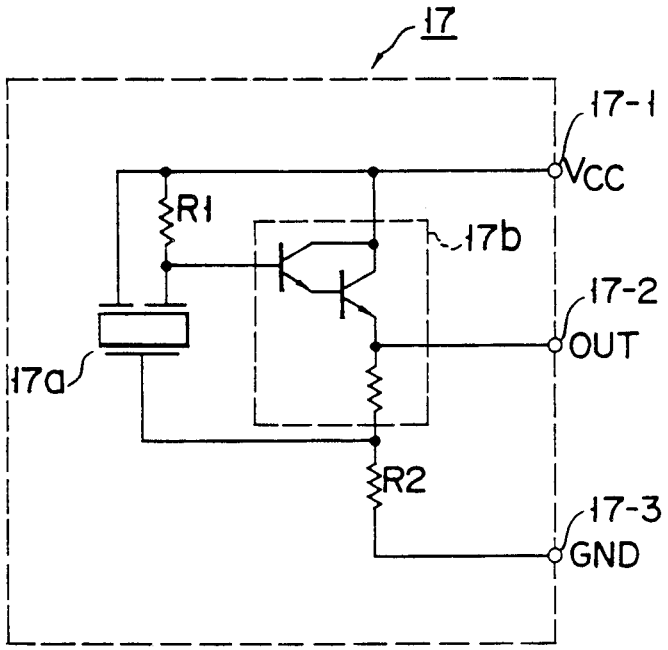
FIG. 2B is a block diagram showing a toner sensor in FIG. 2A.

FIG. 2B shows a detailed circuit arrangement of the toner sensor 17. When, for example, a sufficient amount of toner is stored in the developing unit 12 (FIG. 4), since a piezoelectric element 17*a* is not oscillated due to the pressure of the toner, which serves to press a vibrating plate (not shown), a high-level signal is output from the output terminal 17-2 through a Darlington circuit 17*b*. In contrast to this, when the toner is reduced to a predetermined amount or less, since a voltage of +5 V is applied to the piezoelectric element 17*a* through resistors R1 and R2, the vibrating plate (not shown) begins to vibrate and therefore the element 17*a* begins to oscillate. The oscillation signal is then amplified by the Darlington circuit 17*b* and is output from the output terminal 17-2 to the printer controller 21.

The printer controller 21 comprises a CPU (central processing unit) 22 which receives the above-described oscillation signal and high-level signal, a pull-down resistor $R_D$, and a power source terminal 23 for applying a voltage of +5 V to the toner sensor 17.

Figure 2C:
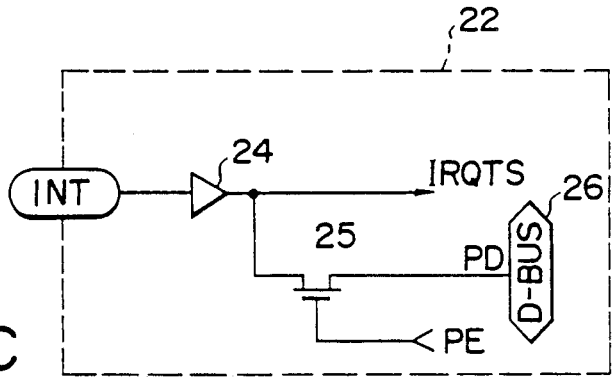
FIG. 2C is a circuit diagram of a CPU in FIG. 2A.

The CPU 22 serves to control the overall printer (not shown). In this embodiment, however, only a circuit associated with the present invention will be described. FIG. 2C shows only part of the circuit arrangement of the CPU 22, more specifically, a partial circuit arrangement of the CPU 22 connected to an interrupt input terminal INT. Upon reception of the above-described oscillation signal through the input terminal INT and a buffer 24, the CPU 22 detects the trailing edge of the oscillation signal and determines that an interrupt signal IRQTS has been input. In addition, the above-described high-level signal or low-level signal which has a ground level due to the pull-down resistor $R_D$ is input, as port data PD, to a data bus 26 in the CPU 22 through a FET 25 in response to a port enable signal PE which is output at a predetermined period. In the image forming apparatus having the above-described arrangement, detection of the residual amount of developer in the developing unit 12 and detection of mounting/dismounting of the developing unit 12 will be described below.

Figure 5:
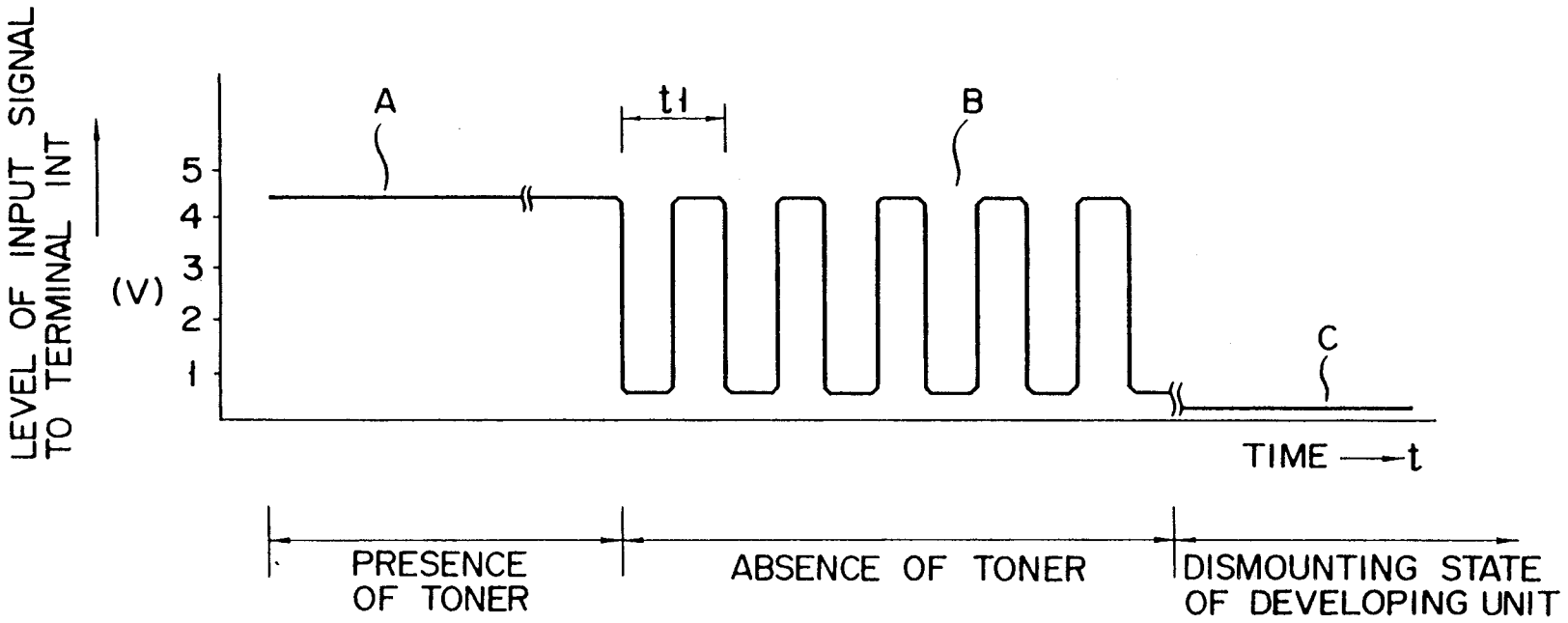
FIG. 5 is a timing chart for explaining an operation of the discriminating unit according to the first embodiment.
Figure 6:
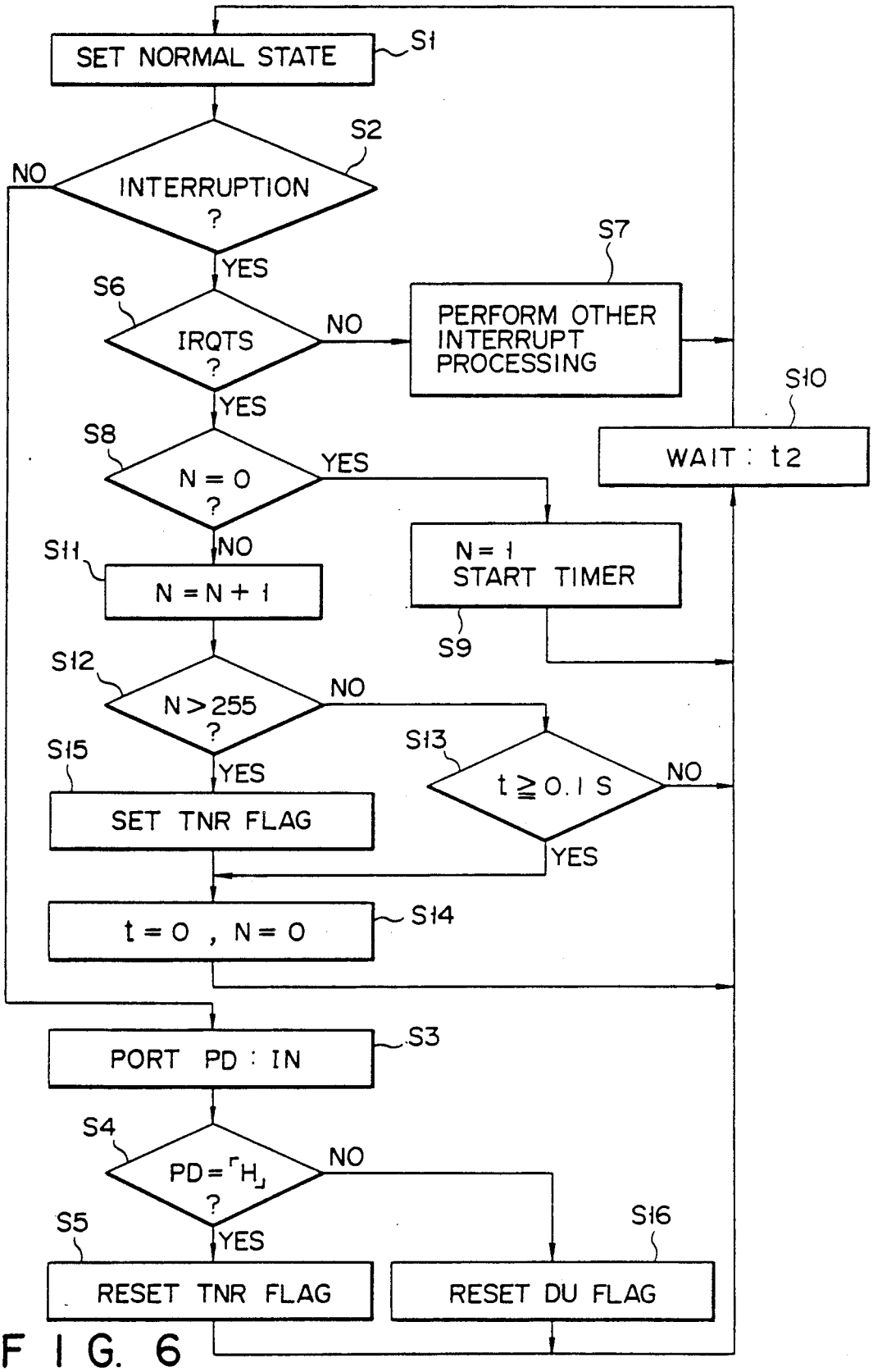
FIG. 6 is a flow chart for explaining an operation of the discriminating unit according to the first embodiment.

When a sufficient amount of toner is present in the hopper 12', since the piezoelectric element 17*a* is not oscillated due to the pressure of the toner, a high-level signal having +5 V is supplied from the output terminal (OUT) of the Darlington circuit 17*b*, i.e., the output terminal 17-2 of the toner sensor 17 to the terminal INT of the CPU 22 through the signal line l2 in response to a predetermined voltage which is input to the Darlington circuit 17*b* through the output terminal 21-1, the power source line l1, the input terminal 17-1, and the resistor R1 in this order. A signal waveform indicated by reference symbol A in FIG. 5 represents the signal input state of the CPU 22 at this time. In this case, since no oscillation signal is output, interruption based on an oscillation signal is not generated (step (denoted by S hereinafter) 2=NO (N)). The high-level signal (+5 V) input to the CPU 22 is input to the FET 25 through the buffer 24, and is output, as port data PD, to the data bus 26 in the CPU 22 in response to a port enable signal PE which is output at a predetermined period (S3). When the high-level signal as the port data PD is input in synchronism with the port enable signal PE, the CPU 22 determines that a sufficient amount of toner is present in the hopper 12' (YES (Y) in S4), and resets a toner (TNR) flag in the CPU 22 (S5).

If the toner is gradually reduced due to a printing operation, and lack of the toner begins to occur, the piezoelectric element 17*a* begins to gradually oscillate. With a decrease in toner, intermittent oscillation is changed to continuous oscillation. As a result, the oscillation signal from the piezoelectric element 17*a* is output from the Darlington circuit 17*b* to the CPU 22 through the output terminal 17-2, the signal line l2, and the input terminal 21-2 in this order. A signal waveform indicated by a reference symbol B in FIG. 5 represents the oscillation signal input to the CPU 22 at this time. In this case, upon detection of the trailing edge of the input oscillation signal, the CPU 22 determines the presence of an interrupt signal (Y in S2), and checks whether the signal is an interrupt signal representing the absence of a toner (S6). This check is made to discriminate the interrupt signal representing the absence of a toner from other interrupt signals which are input through other interrupt input terminals (not shown) of the CPU 22. If an interrupt signal other than the interrupt signal representing the absence of a toner is input, the CPU 22 executes corresponding interrupt processing (N in S6; and S7).

If the CPU 22 determines the oscillation signal (interrupt signal) representing the lack of a toner which is output from the toner sensor 17, it checks whether a count value N of a counter (not shown) therein is "0" (S8). Since the counter is initially set to "0", Y is obtained in the determination step (S8) at first. Subsequently, the count value N is set to be "1", and at the same time, a timer (not shown) in the CPU 22 is started (S9). After a wait time t2 (390 μs or more), the flow returns to a normal print state (S1). If the toner runs short, a pulse signal is input every period of time t1 (set to be 390 μs or less on the basis of the oscillation frequency of the toner sensor), as indicated by reference symbol B in FIG. 5. Therefore, the same determination steps S2, S6, and S8 as described above will be executed upon reception of the next pulse. In this case, since the count value N is "1", N is obtained (S8). Therefore, the count value N is incremented by +1, and it is checked whether the count value N is 255 (to be not more than the number of pulses which are generated in a predetermined period of time (0.1 s) when the oscillation signal is continuously output from the toner sensor at a normal oscillation frequency (390 μs)) (S11 and S12). Since the counter value N at this time is "1" as described above, N is obtained in the determination step (S12) at first. Then, it is checked whether a time t is 0.1 s or more (S13), and the above-described operation is executed (S10). The above-described processing (S10, S1, S2, S6, S8, S11, S12, and S13) is repeated 255 times. With this operation, if, for example, a toner is running short as described above, a pulse signal is intermittently output at first. In such a case, therefore, the timer counts the predetermined time (0.1 s) before the count value N becomes 255 or more, and Y is obtained in the determination step (S13). As a result, the preceding count value N and the timer time t are reset (S14), and the CPU 22 does not determine the absence of a toner.

If lack of a toner in the hopper 12' really occurs, a pulse signal is stably input at the period of the time t1 indicated by reference symbol B in FIG. 5, the count value N exceeds 255 before the timer time t exceeds 0.1 s. Therefore, the CPU 22 determines the absence of a toner, and sets a toner flag (Y in S12; and S15). At the same time, the CPU 22 displays the absence of a toner on the display section (not shown). Thereafter, the CPU 22 resets the timer time t to be "0" (S14). With the above-described operation, the lack of a toner in the hopper 12' can be reliably detected.

The dismounting state of the developing unit 12 can be detected as follows. When the developing unit 12 is not mounted in the printer main body, the ground line l3 is not connected. Therefore, a voltage which is reliably reduced to the ground level by the pull-down resistor $R_D$ is input to the terminal INT of the CPU 22 (reference symbol C in FIG. 5 represents the voltage level of this state). The CPU 22 outputs the port enable signal PE at a predetermined period, and executes the processing (S3) and the determination (S4). Since the above-described voltage of the ground level is applied to the data bus 26 at this time, N is obtained in the determination step (S4). The CPU 22 determines that the developing unit 12 is not mounted, and resets a developing unit (DU) flag (S16). At the same time, the CPU 22 causes the display section (not shown) to display that the developing unit 12 is not mounted, and prohibits the developing operation.

As described above, in this embodiment, the toner sensor 17 and the printer control circuit 21 through the three lines, and the interrupt terminal INT is used as an input port of the CPU 22. With this arrangement, the presence/absence of a toner, and mounting/dismounting of the developing unit 12 are discriminated.

Figure 7:
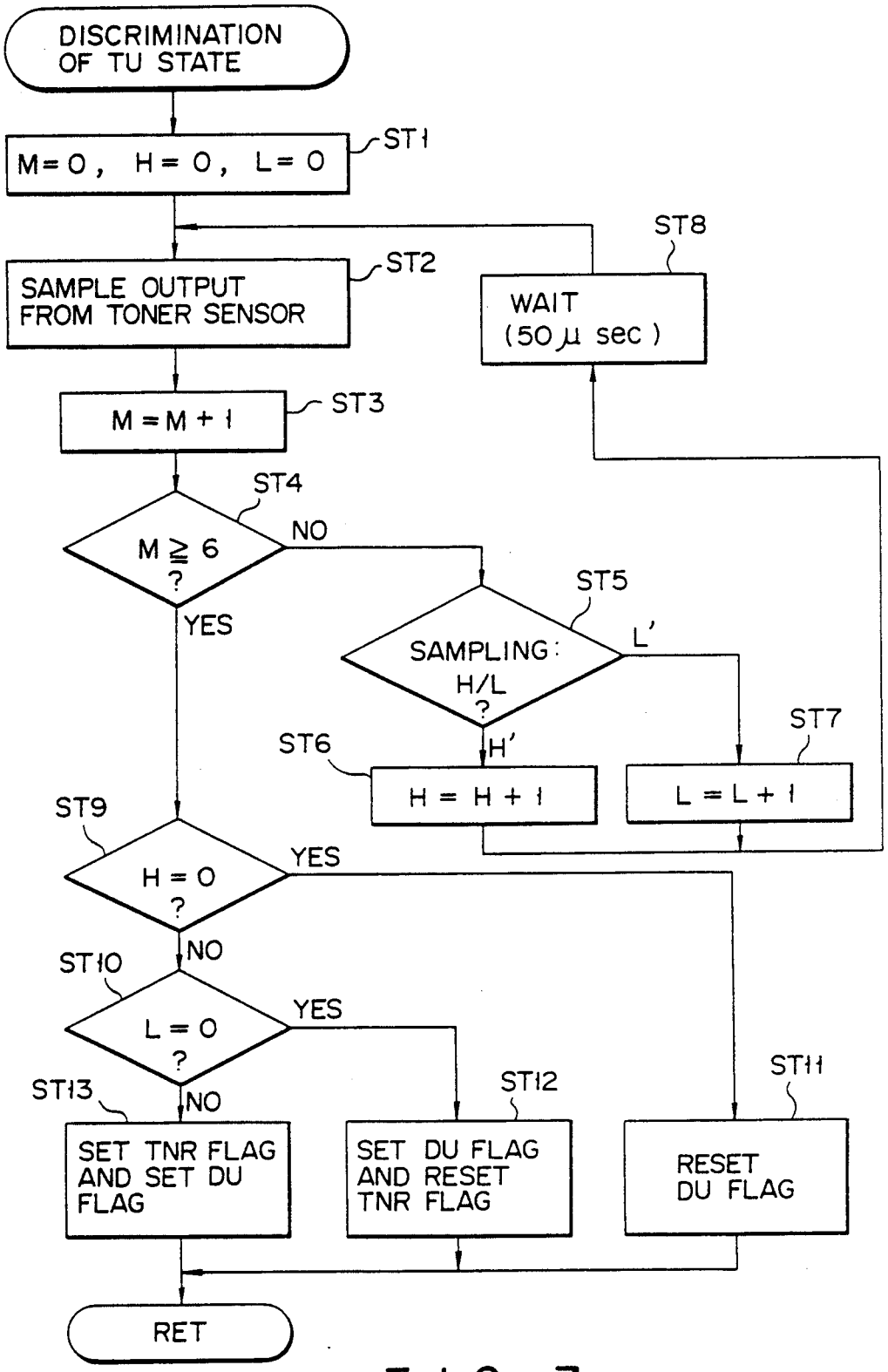
FIG. 7 is a flow chart for explaining an operation of a modification of the discriminating unit of the first embodiment.

A modification of the first embodiment of the present invention will be described below. A circuit arrangement of this modification is substantially the same as that shown in FIGS. 2A and 2B, but is different therefrom in that output signals (an oscillation signal, a high-level signal, and a ground-level signal) from a toner sensor 17 are input to a normal input terminal (input port) of a CPU 22 instead of the interrupt terminal INT. FIG. 7 is a routine of the CPU for determining the presence/absence of a toner and the mounting/dismounting of the developing unit 12 in this modification.

In step (to be referred to as ST hereinafter) 1, count values M, H, and L of counters m, h, and l are set to be "0". An output from the toner sensor 17, which has, e.g., an oscillation period t1 of 300 μsec at the time when a toner is running short, is sampled (ST2). Subsequently, the count value M of the counter m is incremented by 1, and the CPU 22 checks whether the count value M is "6" or more (ST3 and ST4). Since M=1 (N in ST4), determination ST5 is executed. In this determination step, it is checked whether the output signal from the toner sensor 17 which is input from the input port of the CPU 22 has a high or low level. If the sampled output signal from the toner sensor 17 has a high level, the count value H of the counter h is incremented by 1 (H' in ST5; and ST6). If the output signal from the toner sensor 17 has a low level, the count value L of the counter l is incremented by 1 (L' in ST5; and ST6). After a wait time of 50 μsec (ST8), the above-described processing (ST2 to ST8) is repeated five times. When the counter value M of the counter m becomes "6" or more, it is checked whether the count value H of the counter h is "0", and the count value L of the counter l is "0". (ST9, ST10). That is, the CPU 22 fetches six output signals from the toner sensor 17 at intervals of 50 μsec, and checks whether all the output signals are high- or low-level signals. If all the output signals are low-level signals (the count value H is "0"), the CPU 22 determines the state C in FIG. 5, and resets the DU flag (ST11). If all the output signals are high-level signals (the count value L is "0"), the CPU 22 determines the state A in FIG. 5, and sets the DU flag (ST12) (at the same time, the CPU 22 resets the TNR flag). If high- and low-level signals are included in the six sampled output signals, the CPU 22 determines the state B in FIG. 5, sets the TNR flag, and displays the absence of a toner on a display section (not shown) (ST13). At the same time, the DU flag is set.

As described above, according to this modification, the presence/absence of a toner and the mounting/dismounting of the developing unit 12 can be determined without using the interrupt terminal INT.

Figure 8:
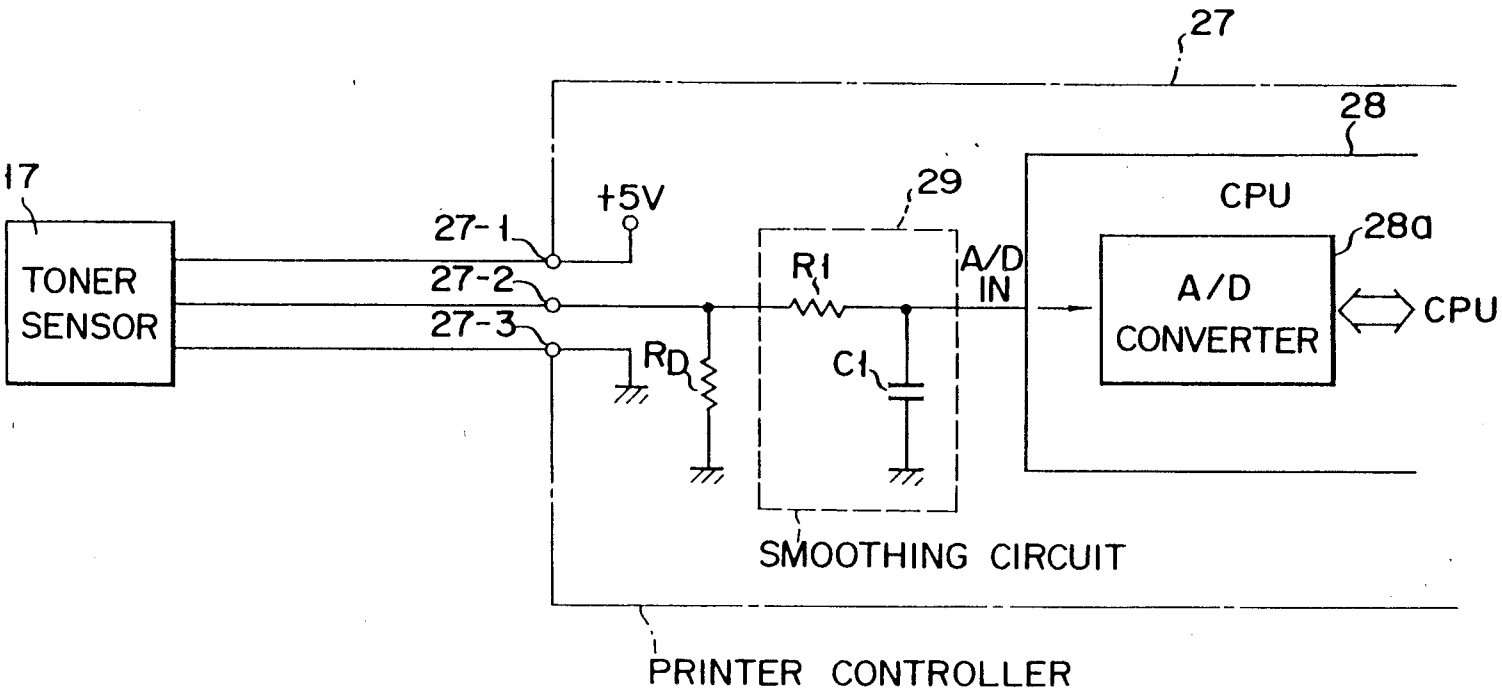
FIG. 8 is a circuit diagram showing a modification of the first embodiment.

Another modification of the present invention will be described below. FIG. 8 is a block diagram showing a circuit arrangement of this modification. Referring to FIG. 8, a printer controller 27 comprises a CPU 28 incorporating an analog/digital converter (to be referred to as an A/D converter hereinafter) 28*a*, a smoothing circuit 29, a pull-down resistor $R_D$, and a power source terminal 30. The functions of the pull-down resistor $R_D$ and the power source terminal 30 are the same as those described with reference to FIG. 2A. In this modification, however, an output signal from a toner sensor 17 is output to the smoothing circuit 29 before it is supplied to the CPU 28, so that the output signal from the toner sensor 17 is smoothed, and an analog signal corresponding to a signal component included in the output signal is output to the A/D converter 28*a* of the CPU 28.

With the above-described arrangement, when an output signal from the toner sensor 17 is of a high level (the state A in FIG. 5), a DC voltage of, e.g., 3.5 V or more is applied from the smoothing circuit 29 to the A/D converter 28*a*. If the output signal from the toner sensor 17 is an oscillation signal (the state B in FIG. 5), a DC voltage of, e.g., 2 to 3 V is applied from the smoothing circuit 29 to the A/D converter 28*a*. If the output signal from toner sensor 17 is a low-level signal (the ground-level state C in FIG. 5), 0 V is applied from the smoothing circuit 29 20 to the A/D converter 28*a*. The CPU 28 can determine the presence/absence of a toner and the mounting/dismounting of a developing unit 12 in real time in accordance with the respective voltages input to the A/D converter 28*a*.

In the above modification, an output signal from the toner sensor 17 may be directly input to the CPU 28 which incorporates the A/D converter 28*a* without using the smoothing circuit 29. In this arrangement, since output signals (output voltages) from the toner sensor 17 fall within the range of 0 to 5 V, and an oscillation signal representing the absence of a toner goes high and low for 100 μs or more, the sampling period of the A/D converter is set to be about 30 μs. With this setting, if, for example, sampling is consecutively performed 10 times, and all the 10 data have 3.5 V or more, the presence of a toner can be determined. Similarly, if all the 10 data have 1.0 V or less, the absence of the developing unit 12 can be determined. If one or more data of the 10 data has 2 V or less or 3.5 V or more, the absence of a toner can be determined.

In the respective modifications, a timer time, counter values, discriminating voltages, and the like can be properly selected in accordance with the conditions of the toner sensor 17 and its peripheral circuits. Also, the developer used in the above-described developing unit is not limited to a one-component magnetic toner. Other developer such as the one made by mixing a one-component magnetic toner and a magnetic carrier can be used, and additives may be added thereto in some cases.

An image forming apparatus according to the second embodiment of the present invention will be described in detail below with reference to the accompanying drawings.

Figure 10:
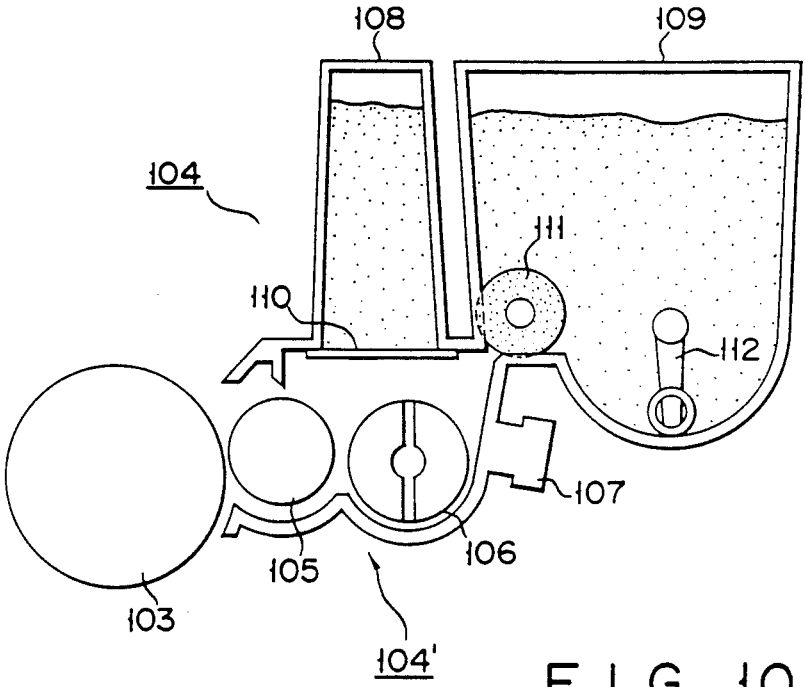
FIG. 10 is a longitudinal sectional view of a developing unit in FIG. 9.

FIG. 10 shows an arrangement of a developing device and a photosensitive drum which are designed to be detachably mounted in the main body of the image forming apparatus of this embodiment. In addition to a developing device 104', the following components (not shown) are arranged near the outer surface of a photosensitive drum 103 in the apparatus main body: a charger; a printing head; and a unit such as a transfer unit for printing an electrostatic latent image, which is formed on the outer surface of the photosensitive drum 103 by an electrophotographic process, on transfer paper. As described above, the photosensitive drum 103 and the developing device 104' constitute an integral developing unit 104 (image forming unit) together with a developer storage section and a toner replenishment section (these sections will be described later). The unit 104 is designed to be detachably mounted in the apparatus main body (not shown).

The developing device 104' comprises: a developing sleeve 105 which brings a developer made by mixing a non-magnetic toner and a magnetic carrier into slidable contact with the photosensitive drum 103 to develop an electrostatic latent image; an agitating member 106 for agitating a developer in the developing device 104'; and a toner density sensor 107 for detecting a toner density and the like of a developer in the developing device 104'. A developer storage section 108 and a toner replenishment section 109 are arranged above the developing device 104'. A developer is stored in the developer storage section 108. The developer is sealed by a developer sealing film 110 and contains a toner having a predetermined density In addition, a replenishment toner to be replenished as the toner is consumed in a developing operation is stored in the toner replenishment section 109. The developer having the predetermined density is stored in the developer storage section in this manner for the following reason. If a newly manufactured developing unit 104 is shipped and transported from a manufacturing factory while a developer is stored in a developing device 104', the developer may leak from the developing device 104'. Therefore, when the developer unit 104 is mounted in the apparatus main body, the developer sealing film 110 must be peeled off first, and the developer in the developer storage section 108 must be moved into the developing device 104'.

In addition blocking of the toner in the toner replenishment section 109 is prevented by an agitating rod 112. Replenishment of a toner is performed by a toner replenishment roll 111 which is rotated in accordance with a toner replenishment signal (to be described later).

Figure 11:
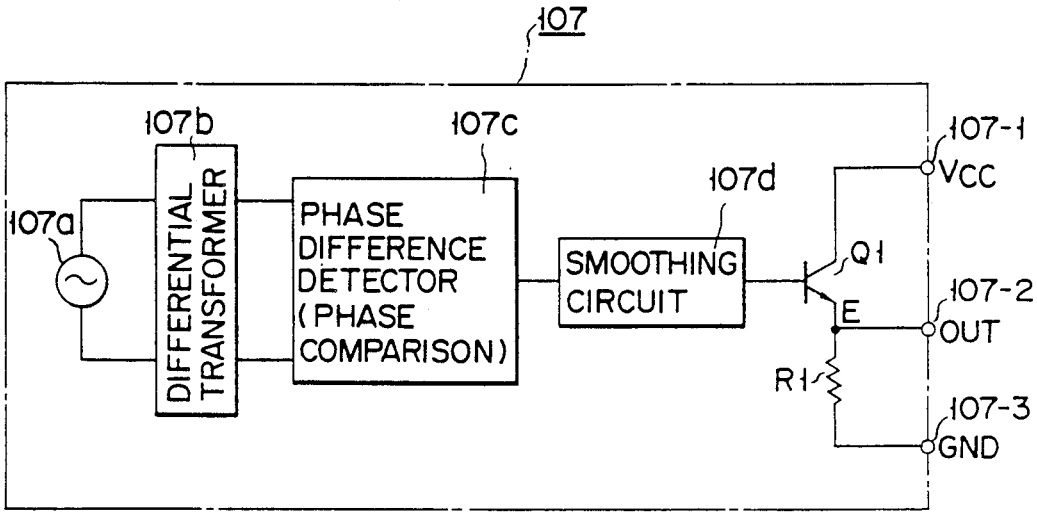
FIG. 11 is a circuit diagram showing a detailed arrangement of a toner sensor in FIG. 9.

The toner density sensor 107 arranged on a side wall of the developing device 104' is a density sensor for detecting a toner density from the permeability of a developer. FIG. 11 shows its circuit arrangement. This circuit is designed such that an AC signal output from an oscillator 107*a* is supplied to a differential transformer 107*b* arranged near the developer, and a phase difference signal, which varies depending on the ratio between a toner and a carrier constituting the developer, is detected by a phase difference detector 107*c* and is smoothed by a smoothing circuit 107*d*. A voltage (analog voltage signal) output from the smoothing circuit 107*d* is applied to a transistor Q1. Then, an analog signal representing a toner density, which appears at the node between the emitter (E) of the transistor Q1 and a resistor R1, is supplied to a printer controller (to be described later). If the carrier in the developer near the toner density sensor 107 is large in amount (a toner amount is small), a phase difference is increased, and the output voltage (analog voltage signal) is increased. If the carrier is small in amount (a toner amount is large), the phase difference is reduced, and the output voltage (analog voltage signal) is lowered.

Figure 12:
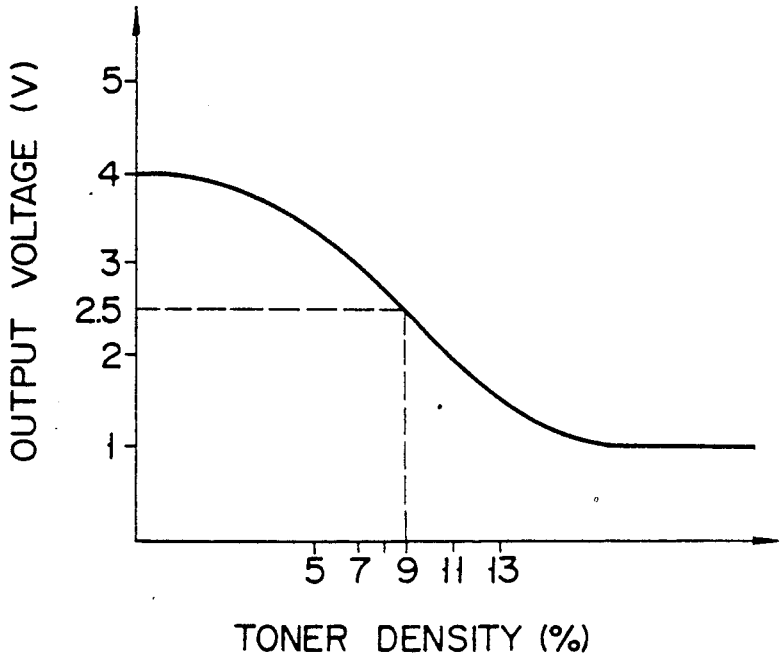
FIG. 12 is a graph showing output voltage characteristics as a function of a toner density.

If, for example, a developer having a standard toner density is stored in the developing device 104', only a small phase difference appears at the secondary coil of the differential transformer due to the ratio of the carrier and the toner. Therefore, an analog voltage signal of, e.g., about 2 V is output from an output terminal 107-2. In contrast to this, if the toner density is decreased, a large phase difference appears at the secondary coil of the differential transformer 107*b*. As a result, the output pulse width of the phase difference detector 107*c* is increased, and an analog voltage signal of, e.g., 3 V is output from the output terminal 107-2. FIG. 12 shows the above-described relationship. In this embodiment, a developer having a toner density of 9% is stored in the developer storage section 8.

Figure 9:
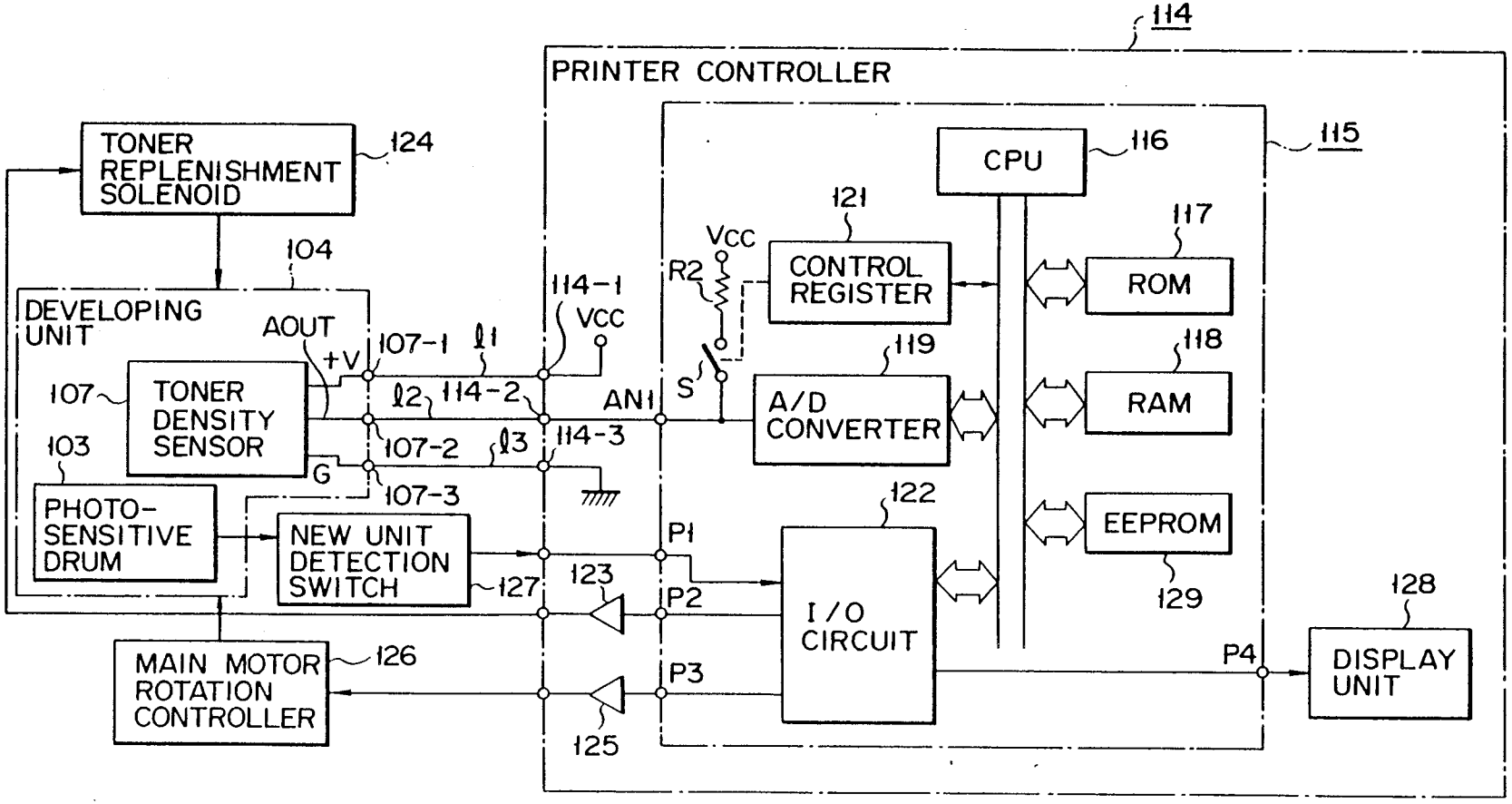
FIG. 9 is a block diagram showing a circuit arrangement of a discriminating unit in an image forming apparatus according to the second embodiment of the present invention.

FIG. 9 shows a circuit arrangement of a printer controller 114 arranged in the image forming apparatus of this embodiment, and a connecting arrangement of the photosensitive drum 103 in the developing unit 104 and the toner density sensor 107 which are connected to the printer controller 114. The printer controller 114 incorporates a one-chip microcomputer 115. In addition to detection of a toner density, the microcomputer 115 detects the mounting/dismounting of the developing unit 104 and the presence/absence of a developer in the developing device 104', and controls an image forming operation. A CPU 116 performs the above-described processing in accordance with a system program stored in a ROM 117, and stores data generated during the processing in a RAM 118.

The toner density sensor 107 and the printer controller 114 are connected to each other through three lines, namely, a power source line l1, an output line l2, and a ground line l3. Power is supplied from the printer controller 114 side to the toner density sensor 107 through an output terminal 114-1, the power source line l1, and an input terminal 107-1. Toner density data (corresponding to the above-described analog voltage signal) from the toner density sensor 107 is supplied to the printer controller 114 through the output terminal 107-2, the output line l2, and an input terminal 114-2. The toner density data supplied to the printer controller 114 through the output line l2, and the like is input to an analog/digital converter (to be referred to as an A/D converter hereinafter) 119 through an input terminal AN1 of the microcomputer 115. The A/D converter 119 converts the supplied voltage data (analog data) representing the toner density into digital data and stores it in the RAM 118 under the control of the CPU 116. Note that the output line l2, is used for detection of the mounting/dismounting state of the developing unit 104 and the presence/absence of a developer as well as detection of a toner density. In addition, the input terminal of the A/D converter 119 is connected to a power source $V_{CC}$ through a switch S and a pull-up resistor R2. For example, when the switch is ON, a voltage ($V_{CC}$) is applied to the A/D converter 119. The switch S is controlled by a control register 121 which is controlled by the CPU 116. The ratio of the resistance of the pull-up resistor R2 to that of a resistor R1 in the toner density sensor 107 is not limited to a specific value, but may be arbitrarily set as long as it does not cause a voltage which appears at the input terminal AN1 when the switch S is closed to coincide with the voltage $V_{CC}$ (for example, other than 1:1).

An input/output circuit (to be referred to as an I/0 circuit hereinafter) 122 outputs a toner replenishment signal to a toner replenishment solenoid 124 through an output port P2 and a buffer 123 under the control of the CPU 116 when toner replenishment is required. When each rotating member in the developing unit 104 including the photosensitive drum 103 is to be rotated, the I/0 circuit 122 outputs a motor rotation start signal to a main motor rotation controller 126 through the buffer 123. Upon reception of the toner replenishment signal, the toner replenishment solenoid 124 rotates the toner replenishment roll 111 a predetermined number of times so as to replenish the developing device 104' with the replenishment toner in the toner replenishment section 109. Upon reception of the motor rotation start signal, the main motor rotation controller 126 rotates a main motor (not shown) to start rotating the photosensitive drum 103. An output from a new unit detection switch 127 for detecting whether the developing unit 104 is new is supplied to the I/0 circuit 122 through an input port P1. In addition, the I/0 circuit 122 outputs display data from an output port P4 to a display unit 128, and displays, e.g., the mounting/dismounting of the developing unit 104 or the presence/absence of a toner in the developing device 104'.

Note that the toner density sensor 107 and the printer controller 114 are commonly grounded by means of the ground line l3 through ground terminals 107-3 and 114-3.

The microcomputer 115 also incorporates an EEPROM 129, in which reference data for correcting the detection characteristics of the toner density sensor 107 is stored, as will be described in detail later.

Figure 13:
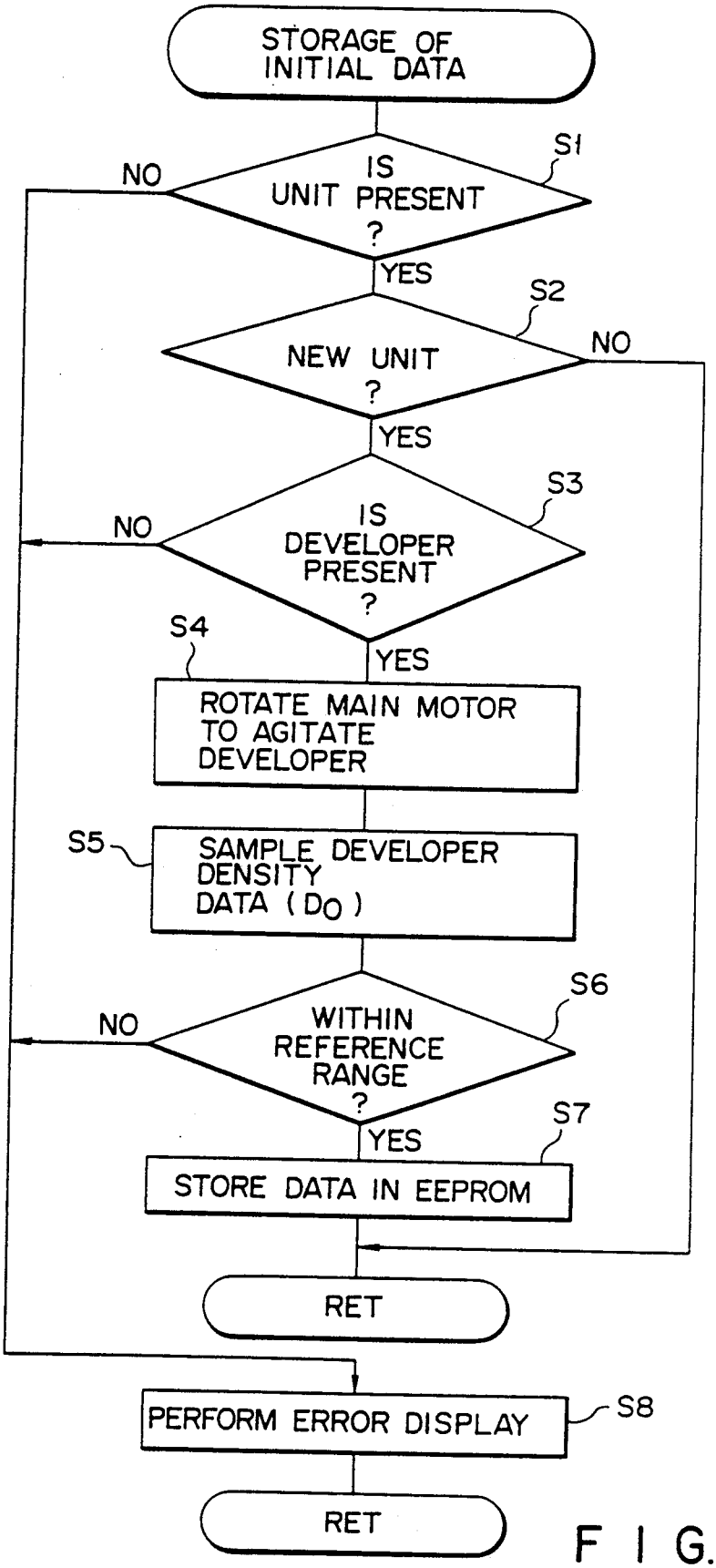
FIGS. 13 to 15 are flow charts for explaining operations of the discriminating unit in FIG. 9.

Especially, detection of the mounting/dismounting of the developing unit 104 and the presence/absence of a toner in the developing device 104', and detection of the density of a developer will be described below in accordance with flow charts in FIGS. 13 to 15.

Processing of storing reference data corresponding to the characteristics of the toner density sensor 107 in the EEPROM 129 will be described first with reference to the flow chart in FIG. 13. This processing is performed for the following reason. A developer stored in the developer storage section 108 has a predetermined toner density (9% as described above) with high precision. However, since the toner density detection characteristics of the toner density sensor 107 varies according to respective parts, it cannot reliably detect a toner density. Therefore, reference data corresponding to the detection characteristics of each toner density sensor 107 must be stored in the EEPROM 129 in advance when the developing unit 104 is exchanged with another unit.

In the first place, it is checked whether the developing unit 104 is mounted in the main body of the image forming apparatus (step (to be referred to as S in FIG. 13) 1). This determination step will be described in detail later with reference to the flow chat in FIG. 14. If it is determined that the developing unit 104 is not mounted, an error display is performed by the display unit 128 so as to inform a user that the developing unit 104 is not mounted (S8). If the developing unit 104 is mounted in the apparatus main body, it is checked whether the developing unit 104 is new (S2). This determination step is performed to check whether a new unit detection signal is output from the new unit detection switch 127. If, for example, the developing unit 104 mounted in the apparatus main body at this time is new, a new unit detection signal is output from the new unit detection switch 127. If this signal is output, the CPU 116 checks whether a developer is stored in the developing device 104' (S3). If no developer is stored in the developing device 104' at this time, the CPU 116 displays an error on the display unit 128 (S8) to remind the user to peel off the developer sealing film 110. If a developer is stored in the developing device 104', the CPU 116 outputs from the I/0 circuit a motor rotation start signal to the main motor rotation controller 126 through the buffer 125 so as to rotate the main motor and the agitating member 106, thus sufficiently agitating the developer in the developing device 104' (S4). The developer is agitated to stabilize the charge of the toner and to match its state with that during an actual developing operation.

Subsequently, the CPU 116 reads out digital data (D) representing a toner density detected by the toner density sensor 107 and output from A/D converter 119 (S5). The CPU 116 then checks whether the readout digital data falls within a reference range (S6). If an output voltage obtained by detecting, e.g., a toner density using the standard toner density sensor 107 has the characteristics shown in FIG. 12, this reference range serves to check whether data which does not greatly deviate from the characteristics is read out as an initial reference data. If, for example, the initial toner density of a developer is 9% as described above, an output voltage of 2.5 V is a standard output voltage. Therefore, if, for example, an output voltage of 2 V or less or 3 V or more is output, the CPU 116 determines that the toner density sensor 107 is defective. If the data falls outside such a reference range, since accurate detection of a toner density cannot be performed by using such a toner density sensor 107, an error display is performed (S8). With this operation, defective products can be easily checked in shipping inspection in a manufacturing factory. If the data falls within the reference range, the digital data output from the A/D converter 122 at this time is, as reference data ($D_0$), written in the EEPROM 129 (S7).

Figure 14:
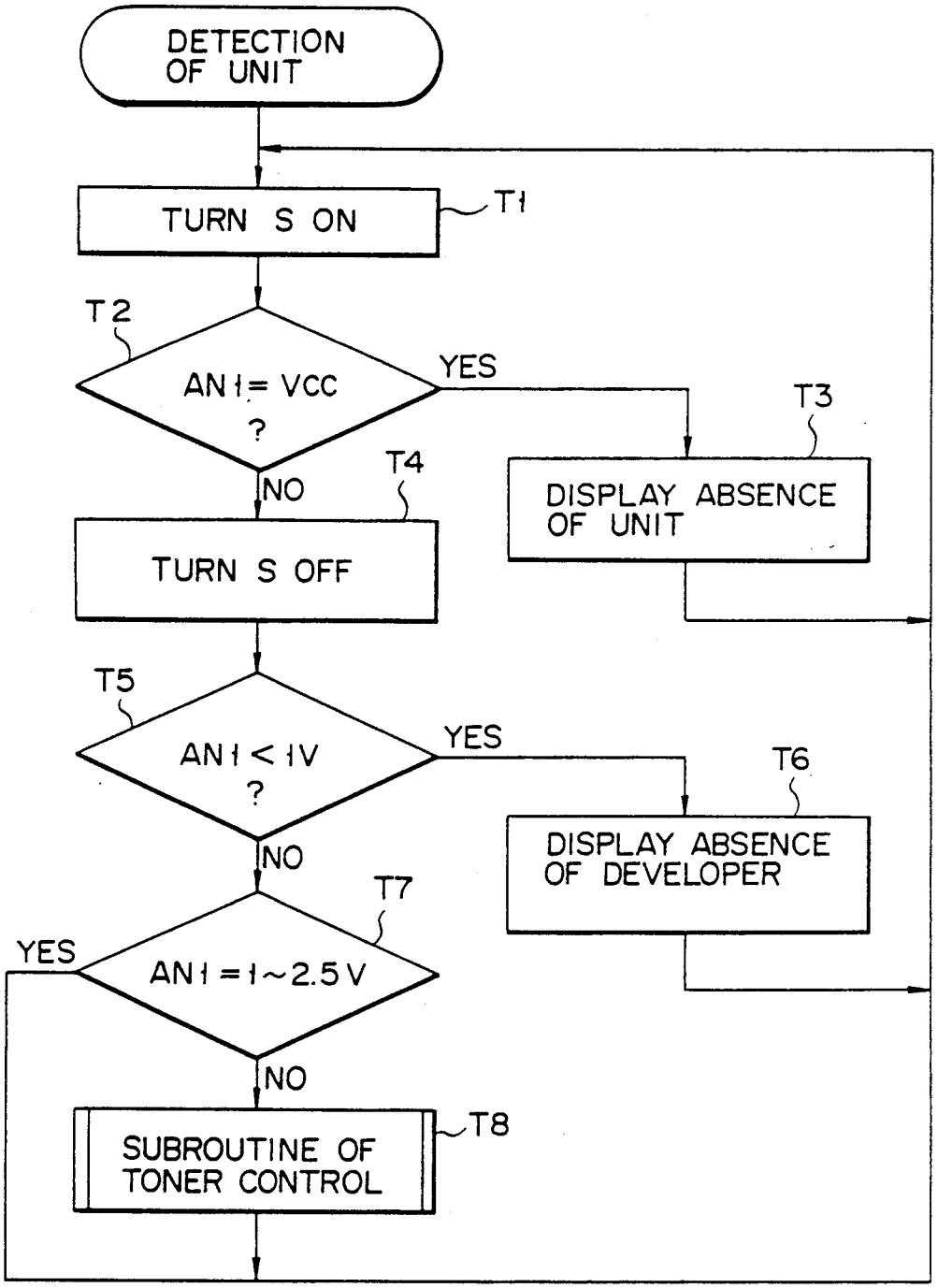

When actual print processing is to be performed after reference data corresponding to the characteristics of each toner density sensor 107 is stored in the EEPROM 129 every time the developing unit 104 is replaced with a new one in the above-described manner, the mounting/dismounting of the developing unit 104 and the presence/absence of a developer in the developing device 104' are checked first in accordance with the flow chart in FIG. 14. This processing is started as follows. The CPU 116 controls the control register 121 so as to turn the switch S on, and checks the value of an input voltage to the A/D converter 119 at this time (step (to be referred to as T in FIG. 14) 1). That is, if the developing unit 104 is not mounted in the apparatus main body, the power source voltage $V_{CC}$ is applied to the A/D converter 119 through the pull-up resistor R2 and the switch S (Y (YES) in T2), and the CPU 116 can determine that the developing unit 104 is not mounted in the apparatus main body (T3). Note that reference symbol A in FIG. 16 indicates input conditions and an output state at this time.

Figures 16, 17:
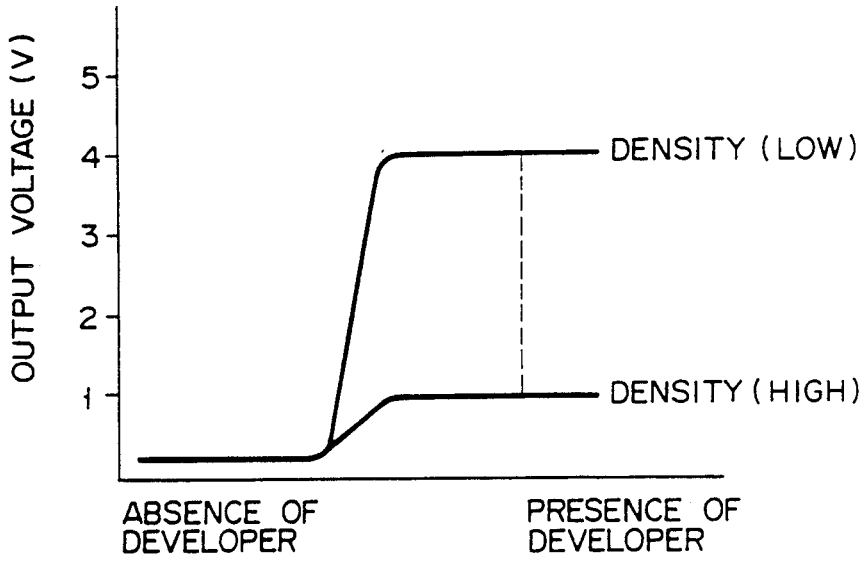
FIG. 16 is a table showing a relationship between conditions, e.g., the presence/absence of a developing unit and the like, and A/D-converted data.
FIG. 17 is a graph showing the output voltages or output voltage widths of the toner sensor as a function of the states of a developer in the developing unit.

If the developing unit 104 is mounted in the apparatus main body, a voltage obtained by dividing the power source voltage $V_{CC}$ by the resistor R2 and the resistor R1 in the toner density sensor 107 is applied to the A/D converter 119. In this case, therefore, the voltage applied to the A/D converter 119 will never become at least $V_{CC}$ due to the ratio of the resistance of the resistor R1 to that of the resistor R1, as described above. With this operation, the CPU 116 can determine that the developing unit 104 is mounted in the apparatus main body (N in T2). If the developing unit 104 is mounted in the apparatus main body, the CPU 116 controls the control register 121 so as to turn the switch S off (T4), and checks whether the analog data output from the toner density sensor 107 is less than 1 V (T5). This determination step is performed for the following reason. Even if the developing unit 104 is mounted in the apparatus main body, the developer cannot be stored in the developing device 104' unless a user peels off the developer sealing film 110. More specifically, due to the characteristics of the toner density sensor 107, its output voltage will never become 1 V or less no matter how high a toner density in the developing device 104' becomes, as shown in FIG. 17. Therefore, if an output voltage applied to the input terminal AN1 through the output line 2 is less than 1 V, the CPU 116 determines that no developer is stored in the developing device 104' (T6), and instructs the user to peel off the developer sealing film 110 of the developer storage section 108. Note that reference symbol B in FIG. 16 indicates input conditions and an output state at this time.

If the voltage applied to the input terminal AN1 is 1 V or more, the CPU 116 determines that a developer is stored in the developing device 104', and executes the next determination step (T7) so as to check whether the output voltage to the input terminal AN1 falls within the range from 1 V to 2.5 V. If the voltage falls outside the above range, the CPU 116 determines that the toner density in the developing device 104' is decreased, and performs toner replenishment control, as will be described detail below (T8).

Figure 15:
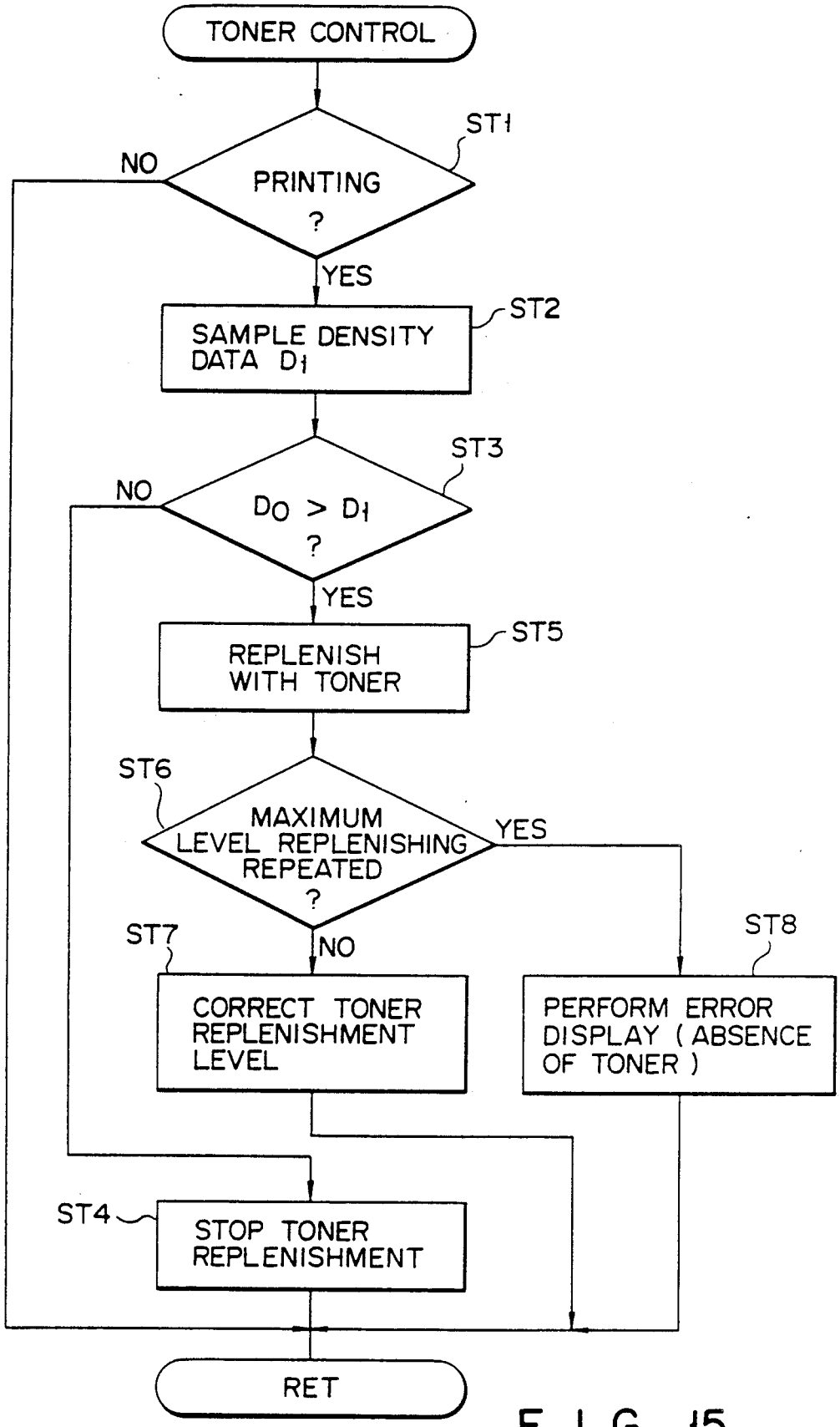

The above toner replenishment control is executed in accordance with the flow chart in FIG. 15. More specifically, in order to detect a toner density while the agitating member 106 is rotated to agitate the developer in the developing device 104', the CPU 116 checks whether printing is being performed (step (to be referred to as ST in FIG. 15) 1). If printing is being performed, the CPU 116 reads out data ($D_1$) obtained by converting an output voltage from the toner density sensor 107 into digital data through the A/D converter 119, and temporarily stores it in the RAM 118 (ST2). Then, the CPU 116 compares the reference digital data $D_0$, which is stored in the EEPROM 129 in the above-described manner, with the digital data $D_1$ stored in the RAM 118 (ST3). If the data $D_1$ sampled by the CPU 116 is smaller than the reference data $D_0$ (N (NO) in ST3), the CPU 116 can determine that the toner density in the developing device 104' is high, and does not control the I/0 circuit 122 to output a toner replenishment signal (ST4). Note that reference symbol E in FIG. 16 indicates input conditions and an output state at this time (regarding standard density detection characteristics of the toner density sensor 107 as indicated by reference symbol C in FIG. 16 as a reference).

If the data $D_1$ sampled by the CPU 116 is larger than the reference data $D_0$ (Y (YES) in T3), the CPU 116 can determine that the toner density in the developing device 104' is low, and outputs a toner replenishment signal to the I/0 circuit 122 so as to rotate the toner replenishment roll 111 and to replenish the developing device 104' with a toner (ST5). In ST5, a toner replenishment amount (toner replenishment level), e.g., the rotation time of the toner replenishment roll 111 is determined in accordance with the value of $D_1$.

The above toner replenishment level ranges from, e.g., level 1 to level 4. Level 4 is the maximum replenishment level. Therefore, if level 1 is detected, the toner replenishment roll is rotated for, e.g., 0.3 seconds. Similarly, the replenishment roll 111 is rotated for 0.5 seconds upon detection of level 2, and is rotated for 0.7 seconds upon detection of level 3. If level 4 is detected, since the toner density has been reduced considerably compared with a reference value, the replenishment roll 111 must be rotated for 0.9 seconds so as to replenish a sufficient amount of toner.

That is, the replenishment roll is rotated for a short period of time if the toner density $D_1$ is slightly lower than the reference level $D_0$, and is rotated for a long period of time if the toner density $D_1$ is much lower than the reference level $D_0$. This prevents an overtoner state due to an excessive toner replenishing operation and an undertoner state. Note that reference symbol D in FIG. 16 indicates input conditions and an output state at this time.

At this time, the CPU 116 checks whether a replenishing operation of a maximum level is repeated continuously a predetermined time (ST6). If the replenishing operation of a maximum level is not repeated, the CPU 116 reads out a new toner density, which is larger than the preceding toner density due to toner replenishment to the developing device 104', from the A/D converter 119 and corrects the data stored in a RAM 118 (ST7). If the replenishing operation of a maximum level is repeated, the CPU 116 determines that the replenishment toner in the toner replenishment section 109 is used up because the toner density is not increased in spite of the fact that a replenishment signal is output. Then, the CPU 116 performs an error display for indicating the absence of a toner (ST8).

As described above, according to this embodiment, the mounting/dismounting of the developing unit 104 and the presence/absence of a toner in the developing device 104' and a toner density can be detected with a small number of connecting lines.

In this embodiment, the developing unit including the photosensitive drum 103 has been exemplified. However, the present invention is not limited to the arrangement including the photosensitive drum 103. In addition, as the toner density sensor 107, a sensor for detecting permeability has been exemplified. However, the present invention is not limited to this type.

An image forming apparatus according to the third embodiment of the present invention will be described in detail below with reference to the accompanying drawings.

Figure 19:
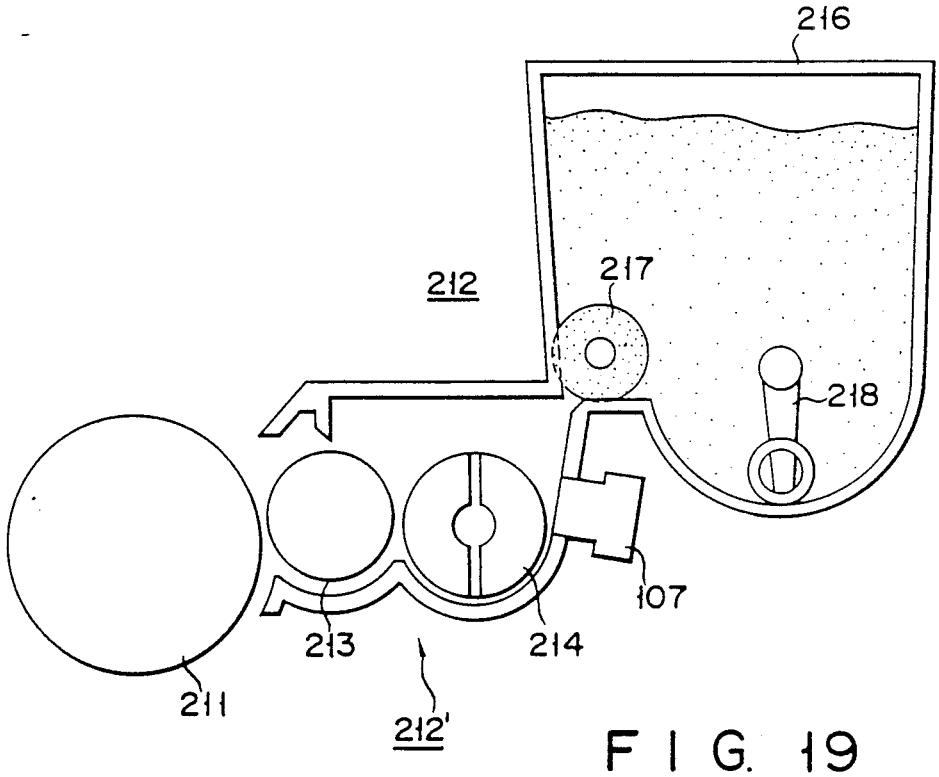
FIG. 19 is a longitudinal sectional view of a developing unit in FIG. 18.

FIG. 19 shows an arrangement of a developing device and a photosensitive drum which are designed to be detachably mounted in the main body in an image forming apparatus of this embodiment. In addition to a developing device 212', the following components (not shown) are arranged near the outer surface of a photosensitive drum 211 mounted in the apparatus main body: a charger; a printing head; and a unit such as a transfer unit for printing an electrostatic latent image, which is formed on the outer surface of the photosensitive drum 211 by an electrophotographic process, on transfer paper. As described above, the photosensitive drum 211, the developing device 212', and a toner replenishment section (to be described later) constitute an integral developing unit 212, which is designed to be detachably mounted in the apparatus main body.

The developing device 212' comprises: a developing sleeve 213 which brings a developer made by mixing a non-magnetic toner and a magnetic carrier into slidable contact with the photosensitive drum 211 to develop an electrostatic latent image; an agitating member 214 for agitating a developer in the developing device 212'; and a toner density sensor 107 for detecting the toner density or the like of a developer in the developing device 212'. A toner replenishment section 216 is arranged above the developing device 212'. A replenishment toner is stored in the toner replenishment section 216 so as to be replenished as a toner is consumed with the progress of a developing operation.

In addition, blocking of the toner in the toner replenishment section 216 is prevented by an agitating rod 218. Replenishment of the toner is performed by a toner replenishment roll 217 (to be described later) which is rotated in accordance with a toner replenishment signal.

A toner density sensor 107 mounted in a side wall of the developing device 212' is a density sensor for detecting a toner density from the permeability of a developer. The sensor 215 has the same circuit arrangement as that shown in FIG. 11, and hence a detailed description thereof will be omitted.

Figure 20:
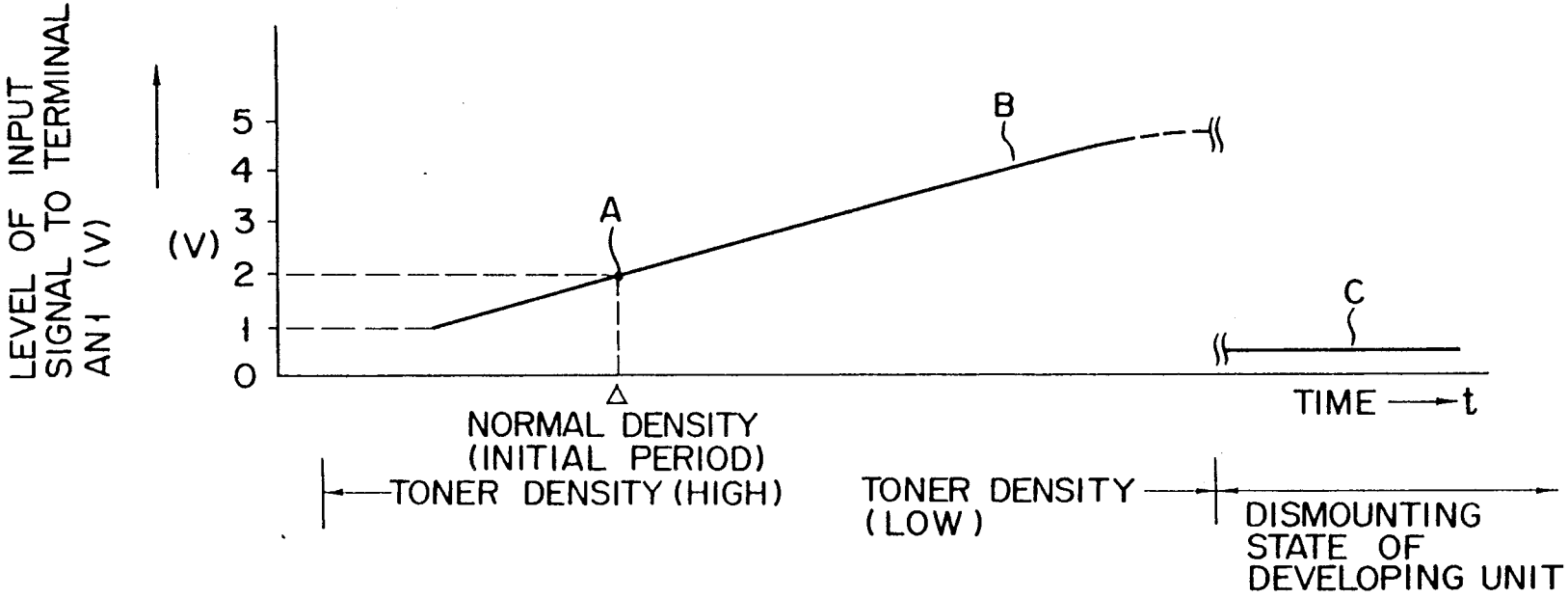
FIG. 20 is a graph showing the output signal waveform form of a toner sensor in FIG. 18.

FIG. 20 shows a relationship between a signal level output from a toner density sensor 107 and the toner density of a developer.

Figure 18:
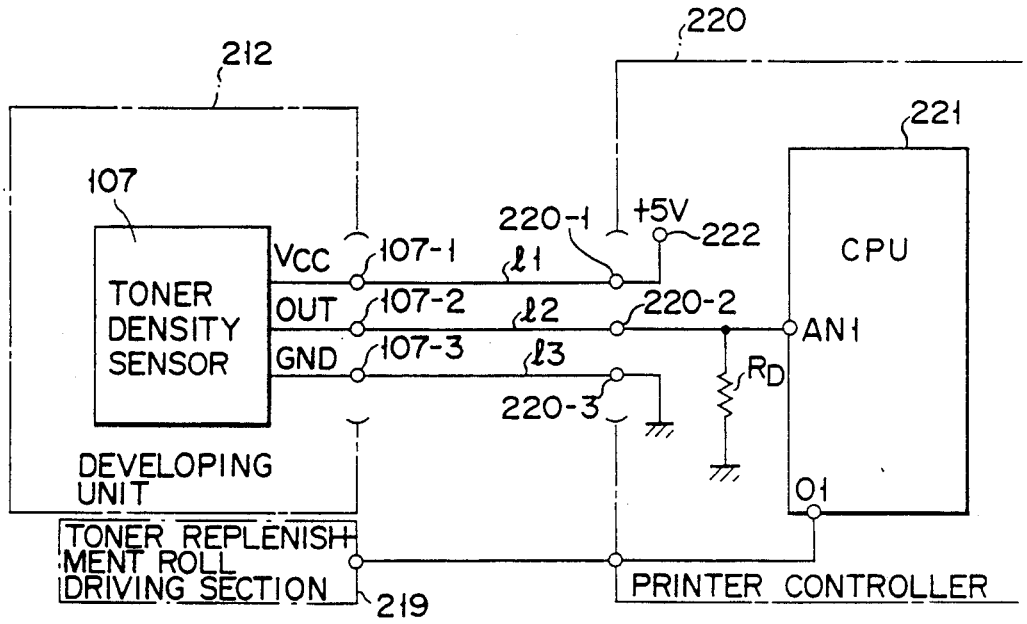
FIG. 18 is a block diagram showing a circuit arrangement of an image forming apparatus according to the third embodiment of the present invention.

FIG. 18 is a block diagram showing a connecting arrangement and a circuit arrangement of the toner density sensor 107 and a printer controller 220. The toner density sensor 107 and the printer controller 220 are connected to each other through three lines, namely, a power source l1, a signal line l2, and a ground line l3. A voltage of 5 V is applied from the printer controller 220 to the toner density sensor 107 through an output terminal 220-1, the power source line l1, and an input terminal 107-1. The above-described analog voltage signal is then supplied from the toner density sensor 107 to the printer controller 220 through an output terminal 107-2, a signal line l2, and an input terminal 220-2. The toner density sensor 107 is connected to the ground of the printer controller 220 through a ground terminal 107-3, the ground line l3, and a ground terminal 220-3.

The printer controller 220 comprises a CPU (central processing unit) 221 for receiving the analog voltage signal representing a toner density, a pull-down resistor $R_D$, a power source terminal 222 for applying a voltage of +5 V to the toner density sensor 107, and the like.

The CPU 221 is a one-chip microcomputer serving as a central processing unit for controlling the overall printer and incorporating a ROM, a RAM, and an A/D converter. In this embodiment, however, only a circuit of the CPU 221 which is associated with the present invention will be described. When the above analog voltage signal is input to the input terminal AN1, the CPU 221 operates the A/D converter to convert the analog voltage signal into a digital signal, and performs determination processing.

With regard to an image forming apparatus having the above-described arrangement, detection of the toner density of a developer in the developing device 212' and detection of the mounting/dismounting of the developing unit 212 will be described below.

If a developer having a standard toner density is present in the developing device 212', a differential transformer **107*a* (shown in FIG. 11) generates an analog voltage signal having a level (+2 V) corresponding to the mixture ratio of a toner (nonmagnetic material) to a carrier (magnetic material). The analog voltage signal is supplied from the output terminal 107-2 of the toner density sensor 107 to the terminal AN1 of the CPU 221 through the signal line l2. A signal level A in FIG. 20 represents the signal input state of the CPU 221** at this time.

Figure 21:
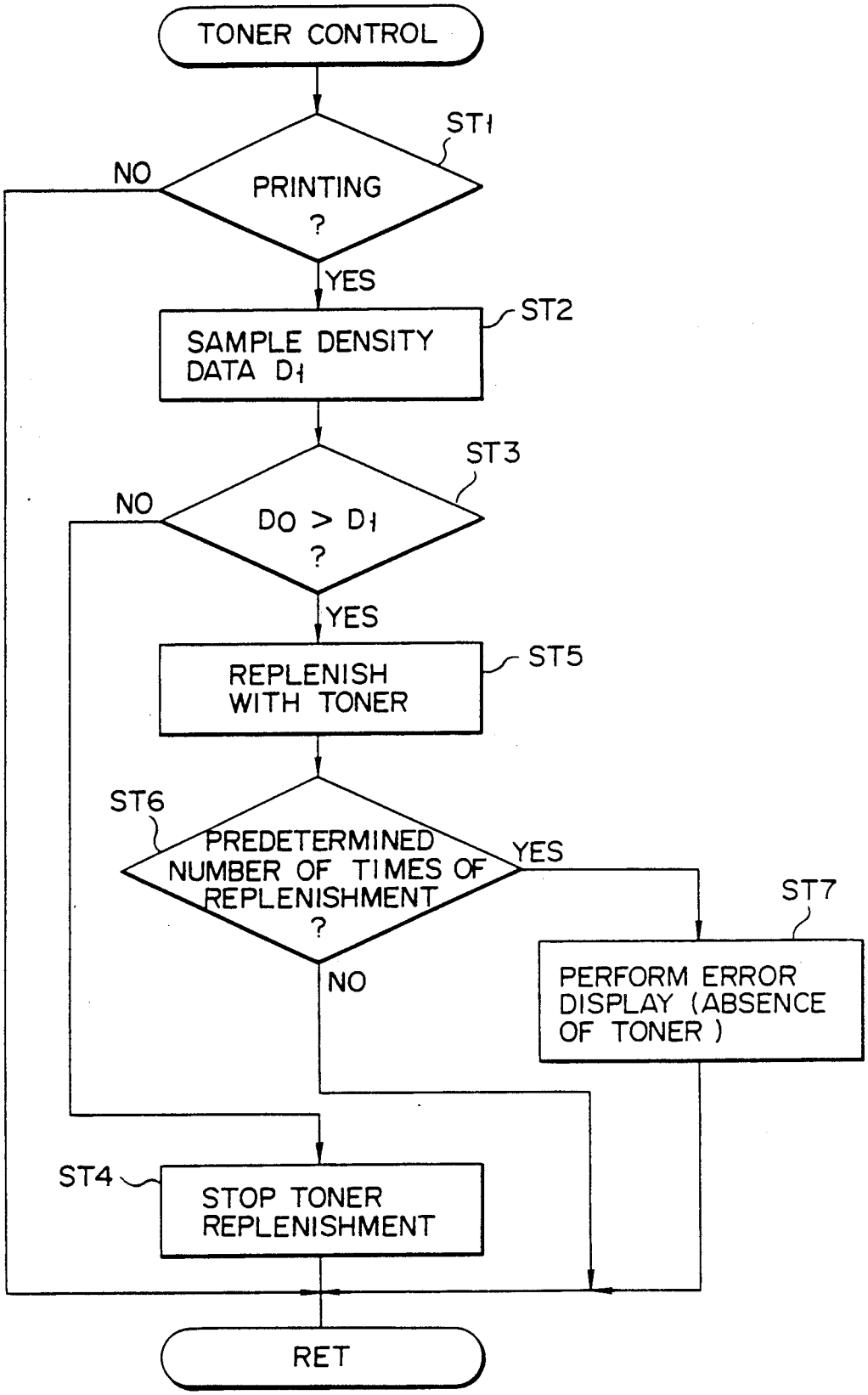
FIGS. 21 and 22 are flow charts for explaining operations of a discriminating unit in FIG. 18.

In this state, the CPU 221 executes toner replenishment control in accordance with a flow chart in FIG. 21. More specifically, in order to detect a toner density while the agitating member 214 is rotated to agitate the developer in the developing device 212', the CPU 221 checks whether the image forming apparatus is performing a printing operation (step (to be referred to as ST in FIG. 21) 1). If printing is being performed, the CPU 221 reads out data ($D_1$) which is obtained by converting the output voltage from the toner density sensor 107 into digital data through the A/D converter in the CPU 221, and temporarily stores it in the RAM (ST2). The CPU 221 compares reference digital data $D_0$ stored in the ROM beforehand with the digital data $D_1$ stored in the RAM (ST3). If the reference data $D_0$ is smaller than the data $D_1$ sampled by the CPU 221 (N (NO) in ST3), the CPU 221 can determine that the toner density in the developing device 212' is high, and does not perform control for outputting a toner replenishment signal (ST4).

If the toner is gradually reduced due to a print operation, and the toner density is decreased, a secondary phase deviation of the differential transformer **107*b* is gradually caused by changes in magnetic resistance due to an increase in density of the carrier. This phase deviation is sequentially increased with a decrease in toner. For this reason, the width of a pulse output from a phase difference detector 107*c* is increased, and the level of the analog voltage signal obtained by smoothing this output pulse is increased. A state B in FIG. 20 represents the analog voltage signal input to the CPU 221 through the input terminal 220-2 at this time. In this case, the reference data $D_0$ is larger than the data $D_1$ sampled by the CPU 221 in the flow chart in FIG. 21 (Y (YES) in ST3), and the CPU 221 can determine that the toner density in the developing device 212' is low. Therefore, the CPU 221 outputs a toner replenishment signal from an output terminal 01, and rotates the toner replenishment roll 217 for a predetermined period of time, thereby replenishing the developing device 212'** with the toner (ST5).

In addition, the CPU 221 checks whether a toner replenishment operation is successively performed a number of times exceeding a predetermined number of times within a predetermined period of time (ST6). If NO in ST6, the replenishment processing is continued. If YES in ST6, the CPU 221 determines that the replenishment toner in the toner replenishment section 216 is used up because the toner density is not increased in spite of the fact that the toner replenishment signal is output to repeatedly command the developing device 212' to replenish the toner (Y in ST6). Then, the CPU 221 performs an error display for representing the absence of a toner (ST7).

With the above-described processing, a decrease in toner density of an developer in the developing device 212' and the absence of a toner in the toner replenishment section can be reliably detected.

Figure 22:
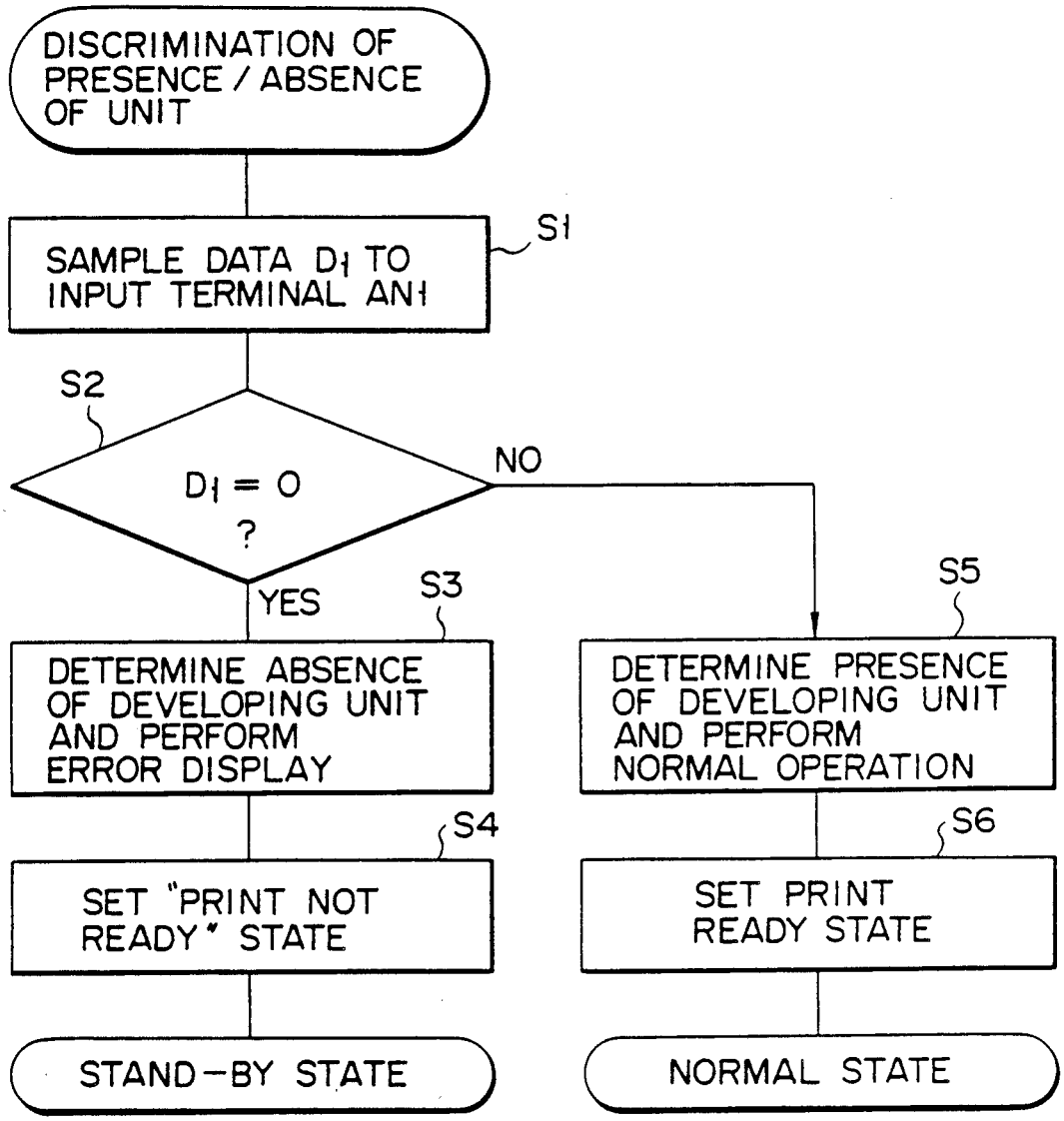

In an initialization period when the power switch of the apparatus is turned on, the dismounting state of the developing unit 212 is detected in the following manner. When the developing unit 212 is not mounted, since the signal line l2 is not connected, a voltage which is perfectly lowered to the ground level by the pull-down resistor $R_D$ is input to the terminal AN1 of the CPU 221 (a state C in FIG. 20 represents this voltage level). The CPU 221 executes A/D conversion (step (to be referred to as S in FIG. 22) 1), and checks whether sampled data $D_1$ is a voltage of 0 V (digital data "00") (S2).

If the sampled data $D_1$ is "00" (Y in S2), the CPU 221 determines that the developing unit 212 is not mounted, and causes the display section to display that the developing unit 212 is not mounted (S3). At the same time, the CPU 221 inhibits printing. If the sampled data $D_1$ has a value other than "00" (N in S2), the CPU 221 determines that the developing unit is properly mounted (S5), and performs processing for print ready state (S6).

As has been described above, in this embodiment, the toner sensor 215 and the printer controller 220 are connected to each other through the three lines, and a toner density and the mounting/dismounting state of the developing unit 212 are discriminated by discriminating signals input to the single input terminal AN1 of the CPU 221.

It is apparent that the value of the discrimination voltage in the above-described embodiment can be arbitrarily selected in accordance with the conditions of the toner density sensor 107 and its peripheral circuits.

Additional advantages and modifications will readily occur to those skilled in the art. Therefore, the invention in its broader aspects is not limited to the specific details, and representative devices, shown and described. Accordingly, various modifications may be made without departing from the spirit or scope of the general inventive concept as defined by the appended claims and their equivalents.

What is claimed is:

1. An image forming apparatus comprising:

an image forming unit, detachably mounted in a main body of said image forming apparatus and having at least a developing device for storing a predetermined developer for forming a desired image;

sensor means, arranged on the side of said image forming unit, for detecting a state of the developer in said developing device and generating a detection signal;

connecting means, arranged on the side of said image forming unit, for outputting the detection signal generated by said sensor means to said main body;

transmitting means, having a single portion to be connected arranged on said main body side, for transmitting, to said main body side, the detection signal generated by said sensor means and a signal representing a mounting state of said image forming unit, which is generated in accordance with a coupling state of said connecting means of said image forming unit with respect to said single portion to be connected; and discriminating means, having a single input terminal for receiving a signal from said single portion of said transmitting means, for discriminating a state of the developer in said developing device and a mounting state of said image forming unit with respect to said main body on the basis of a state of the signal input to said input terminal.

2. An apparatus according to claim 1, wherein said developing device comprises means for performing a developing operation by using one of a developer containing only a magnetic toner and a developer containing a magnetic toner and a magnetic carrier.

3. An apparatus according to claim 1, wherein said developing device comprises means for performing a developing operation by using a two-component developer containing a toner and a carrier.

4. An apparatus according to claim 2, wherein said sensor means comprises a piezoelectric sensor.

5. An apparatus according to claim 3, wherein said sensor means comprises means for detecting a permeability of the two-component developer which is determined by a mixture ratio of the toner to the carrier.

6. An apparatus according to claim 1, wherein said single input terminal is held at a predetermined potential when said connecting means of said image forming unit is in a non-coupling state with respect to said single portion of said main body, and the potential of said single input terminal depends on a potential of said connecting means when said connecting means is in a coupling state.

7. An apparatus according to claim 6, wherein the detection signal from said sensor means includes two states, i.e., a state of a specific potential and an oscillation state, the specific potential being different from the predetermined potential.

8. An apparatus according to claim 1, wherein said sensor means includes means for detecting the presence/absence of the developer.

9. An apparatus according to claim 1, wherein said sensor means includes means for detecting the presence/absence of the developer, and means for detecting a toner density of the developer.

10. An apparatus according to claim 1, wherein said sensor includes means for detecting a toner density in the developer.

11. An apparatus according to claim 5, wherein said sensor means includes means for detecting a toner density in the developer, and the detection signal from said sensor means continuously varies in level in accordance with the toner density in the developer.

12. An apparatus according to claim 5, wherein the detection signal from said sensor means is held at a specific potential when no developer is present around said sensor means.

13. An apparatus according to claim 4, wherein said discriminating means comprises a microcomputer, and said single input terminal serves as an interrupt terminal of said microcomputer.

14. An apparatus according to claim 4, wherein said discriminating means comprises a microcomputer, and said single input terminal serves as an input terminal of said microcomputer.

15. An apparatus according to claim 1, wherein said discriminating means comprises an A/D converter for receiving and A/D-converting the signal input to said single input terminal, and discriminates a state of the developer in said developing device and a mounting state of said image forming unit with respect to said main body on the basis of an output from said A/D converter.

16. An apparatus according to claim 9, further comprising switching means, coupled between said single input terminal of said discriminating means and a voltage source, for bringing said single input terminal to a state in which a predetermined voltage is applied from the voltage source or a state in which no voltage is applied from the voltage source.

17. An apparatus according to claim 16, wherein said discriminating means includes means for discriminating a mounting/dismounting state of said image forming unit when the predetermined voltage is applied to said single input terminal from the voltage source, and discriminating the presence/absence and toner density of the developer when no voltage is applied to said single input terminal.

18. An apparatus according to claim 1, wherein said transmitting means comprises a transmission line for transmitting the signal from said single portion to said single input terminal of said discriminating means when said image forming unit is mounted in said main body, and predetermined potential applying means for holding said transmission line at a predetermined potential when said image forming unit is not mounted in said main body.

19. An apparatus according to claim 18, wherein said transmitting means comprises a transmission line for transmitting the signal from said single portion to said single input terminal of said discriminating means when said image forming unit is mounted in said main body, and switching means for connecting or disconnecting said transmission line to or from said predetermined potential applying means.

20. An apparatus according to claim 9, further comprising nonvolatile storage means for storing reference data for discriminating a toner density on the basis of the detection signal from said sensor means when said discriminating means detects a change in state from the absence of a developer to the presence of a developer.

* * * * *